US011391446B2

(12) United States Patent
Amin

(10) Patent No.: US 11,391,446 B2
(45) **Date of Patent: *Jul. 19, 2022**

(54) SUSPENDED LUMINAIRE

(71) Applicant: Hubbell Lighting, Inc., Shelton, CT (US)

(72) Inventor: Gaurav Amin, Simpsonville, SC (US)

(73) Assignee: Hubbell Lighting, Inc., Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/078,937

(22) Filed: Oct. 23, 2020

(65) Prior Publication Data

US 2021/0041088 A1 Feb. 11, 2021

Related U.S. Application Data

(63) Continuation of application No. 16/355,004, filed on Mar. 15, 2019, now Pat. No. 10,845,037.

(60) Provisional application No. 62/643,941, filed on Mar. 16, 2018.

(51) Int. Cl.

| | |
|---|---|
| ***F21V 19/00*** | (2006.01) |
| *F21Y 103/10* | (2016.01) |
| *F21Y 115/10* | (2016.01) |

(52) U.S. Cl.

CPC ..... *F21V 19/003* (2013.01); *F21Y 2103/10* (2016.08); *F21Y 2115/10* (2016.08)

(58) Field of Classification Search

CPC .. F21V 19/003; F21V 23/008; F21Y 2115/10; F21Y 2103/10; F21Y 2105/16; F21S 8/06

See application file for complete search history.

(56) References Cited

U.S. PATENT DOCUMENTS

| | | | | |
|---|---|---|---|---|
| 7,665,862 | B2 ‡ | 2/2010 | Villard | F21V 14/02 362/249.02 |
| 8,113,687 | B2 ‡ | 2/2012 | Villard | F21V 17/107 362/249.01 |
| D663,882 | S | 7/2012 | Muraishi | |
| D703,858 | S | 4/2014 | Miller | |
| D721,198 | S | 1/2015 | Glasbrenner | |
| D744,690 | S | 12/2015 | Boyer | |
| D747,529 | S | 1/2016 | Yoon | |
| D749,768 | S | 2/2016 | Snell | |
| D757,327 | S | 5/2016 | Reynolds | |
| D762,322 | S | 7/2016 | Scribante | |
| D774,234 | S | 12/2016 | Plourde | |
| 9,644,828 | B1 ‡ | 5/2017 | May | F21S 4/28 |

(Continued)

*Primary Examiner* — Kevin Quarterman

(74) *Attorney, Agent, or Firm* — Michael Best & Friedrich LLP

(57) ABSTRACT

A luminaire includes a first portion, a second portion, and a third portion. The first portion extends along a first axis and supports a first light emitter. The second portion is laterally spaced from the first portion and extends along a second axis that is oriented parallel to the first axis. The second portion supports a second light emitter. The third portion is disposed laterally between the first portion and the second portion and extends along a third axis that is oriented parallel to the first axis. The third portion supports at least one current driver for driving at least one of the first light emitter and the second light emitter.

19 Claims, 19 Drawing Sheets

(56) References Cited

U.S. PATENT DOCUMENTS

| | | | | |
|---|---|---|---|---|
| D791,999 | S | 7/2017 | Hargreaves | |
| D799,102 | S | 10/2017 | Tweel | |
| D809,701 | S | 2/2018 | Tweel | |
| D819,861 | S | 6/2018 | Scribante | |
| D819,862 | S | 6/2018 | Deng | |
| D819,875 | S | 6/2018 | Yorio | |
| D822,885 | S | 7/2018 | Tweel | |
| D877,964 | S | 3/2020 | Antony | |
| 10,845,037 | B2 * | 11/2020 | Amin | F21S 8/06 |
| 2010/0296285 | A1 ‡ | 11/2010 | Chemel | F21S 2/005 362/235 |
| 2016/0366746 | A1 ‡ | 12/2016 | van de Ven | F21K 9/235 |

* cited by examiner
‡ imported from a related application

SUSPENDED LUMINAIRE

REFERENCE TO RELATED APPLICATIONS

This application is a continuation of co-pending U.S. patent application Ser. No. 16/355,004, filed Mar. 15, 2019, which claims the benefit of prior-filed, U.S. Provisional Patent Application No. 62/643,941, filed Mar. 16, 2018, the entire contents of which are incorporated by reference.

FIELD

The present disclosure relates to a luminaire and more specifically to an overhead luminaire.

BACKGROUND

Suspended luminaires may be supported away from a ceiling surface in various ways.

SUMMARY

In one embodiment, a luminaire includes a first portion, a second portion, and a third portion. The first portion extends along a first axis and supports a first light emitter. The second portion is laterally spaced from the first portion and extends along a second axis that is oriented parallel to the first axis. The second portion supports a second light emitter. The third portion is disposed laterally between the first portion and the second portion and extends along a third axis that is oriented parallel to the first axis. The third portion supports at least one current driver for driving at least one of the first light emitter and the second light emitter.

In another embodiment, a luminaire includes a first portion, a second portion, and a third portion. The first portion includes a first end and a second end. A first axis extends between the first and second ends. The first portion supports a first light emitting diode. The second portion includes a first end and a second end. A second axis extends between the first and second ends and is oriented parallel to the first axis. The second portion supports a second light emitting diode and is laterally spaced from the first portion. The third portion is disposed between the first portion and the second portion. The third portion includes a first end and a second. A third axis extends between the first end and the second end and is parallel to the first axis. The third portion is spaced apart from the first portion and the second portion. The third portion also supports a first current driver that is in electrical communication with the first light emitting diode and a second current driver that is in electrical communication with the second light emitting diode. A first bracket is coupled to a first end of the first portion, a first end of the second portion, and a first end of the third portion. A second bracket is coupled to the second end of the first portion, a second end of the second portion, and a second end of the third portion.

In yet another embodiment, a luminaire includes a first portion, a second portion, and a third portion. The first portion extends along a first axis and supports a first light emitter. A second portion is laterally spaced from the first portion and extends along a second axis that is parallel to the first axis. The second portion supports a second light emitter. The third portion is disposed between the first portion and the second portion and extends along a third axis that is parallel to the first axis. The third portion supports at least one current driver to drive at least one of the first light emitter and the second light emitter. A cover is removably coupled to the third portion using fasteners. The fasteners are rotatable between a first position where the cover is coupled to the third portion and a second position where the cover is decoupled from the third portion. The second position is ninety degrees form the first position.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to a suspended light fixture or luminaire. The luminaire includes a first portion housing a light engine and a second portion housing one or more light emitting devices powered by the light engine. The first portion and the second portion are spaced apart from one another so that the light engine and the light emitters are housed in different sections of the luminaire.

Figure 1A:
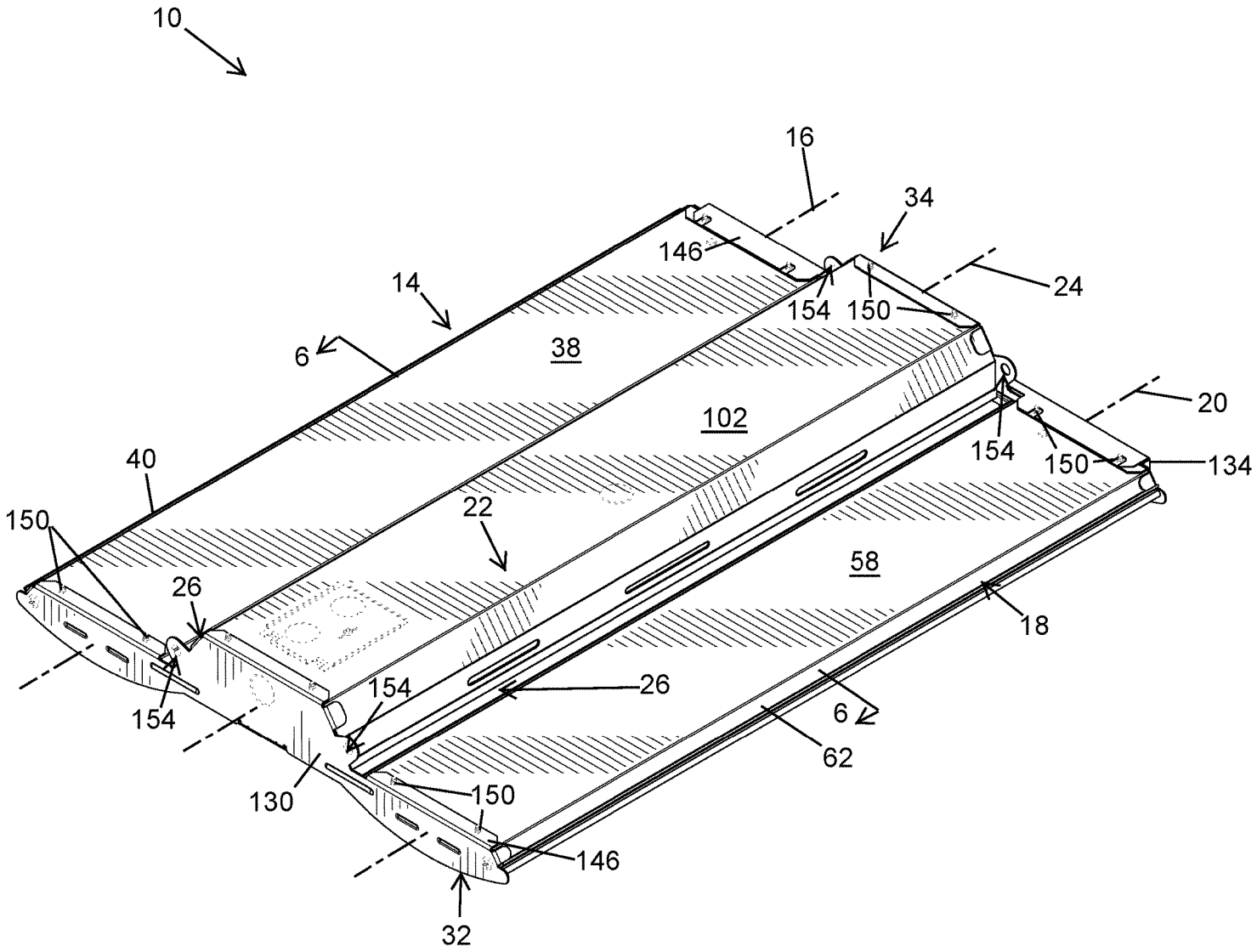
FIG. 1A is an upper perspective view of a luminaire.
Figure 1B:
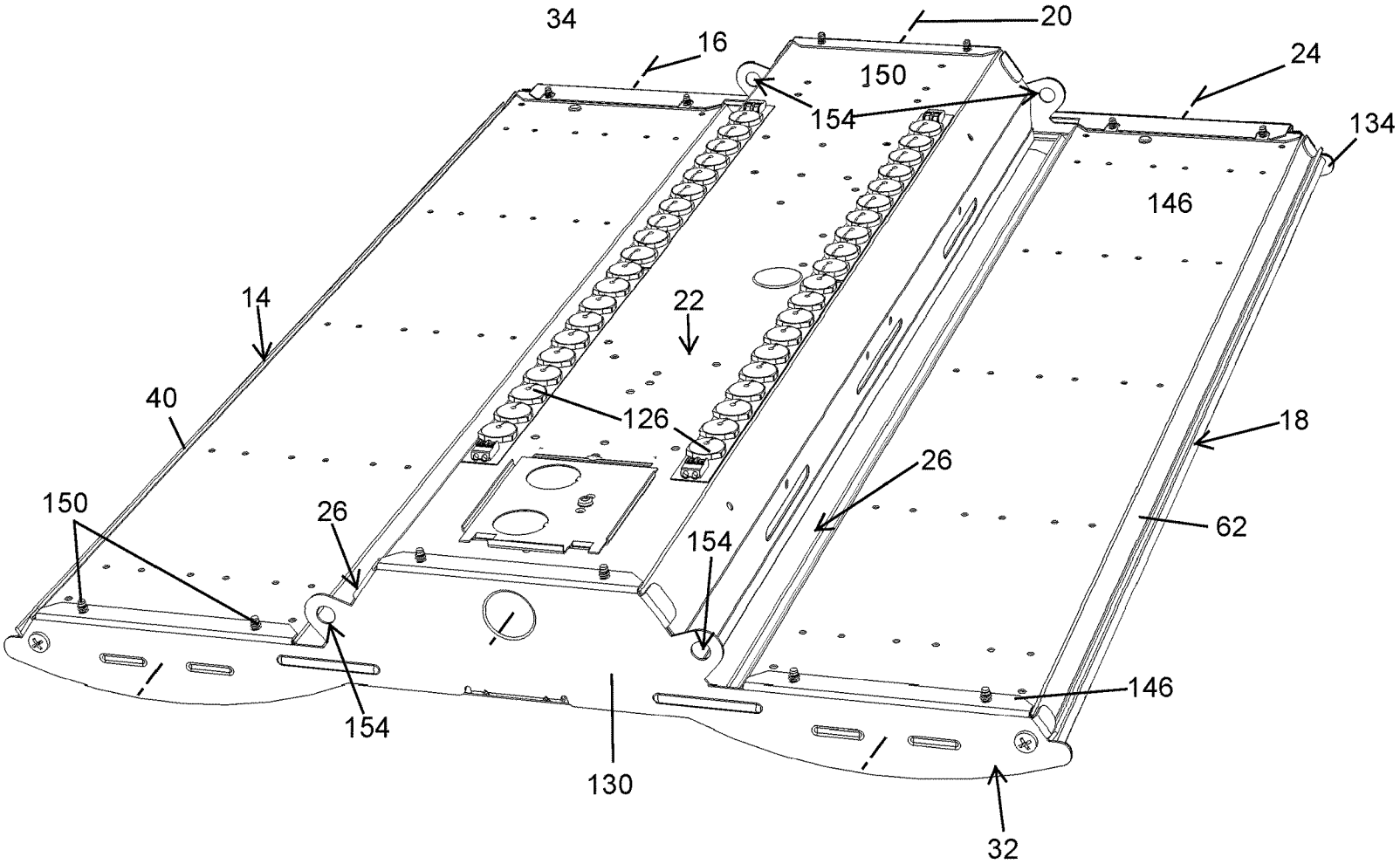
FIG. 1B is an upper perspective view of the luminaire of FIG. 1A including upwardly oriented light emitting devices.
Figure 2:
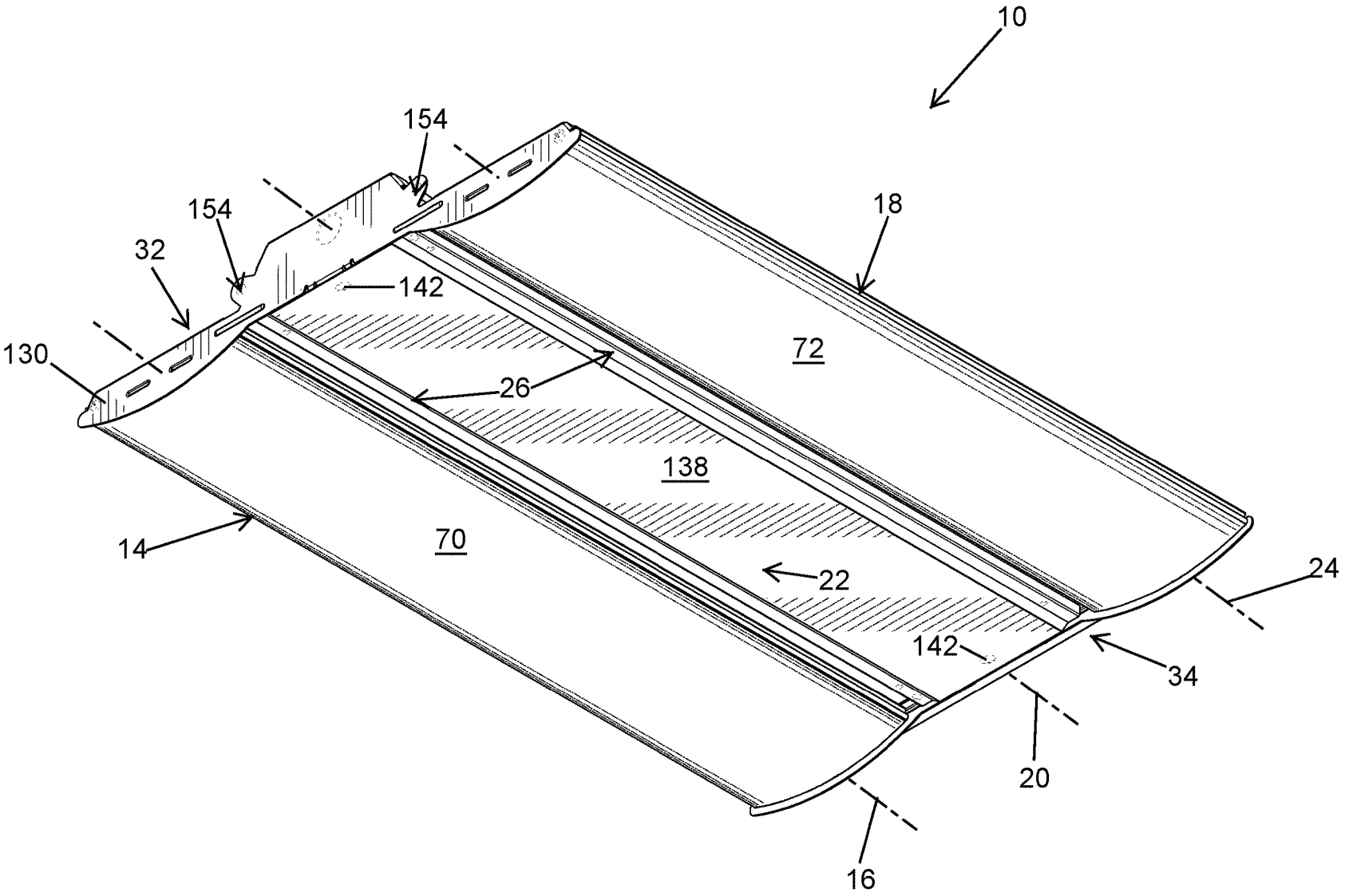
FIG. 2 is a lower perspective view of the luminaire of FIG. 1A.

As shown in FIGS. 1A-2, a luminaire 10 includes distinct portions. In the illustrated embodiment, the luminaire 10 includes a first tray or first portion 14 extending along a first axis 16, a second tray or second portion 18 extending along a second axis 20, and a channel or third portion 22 extending along a third axis 24. Each of the portions 14, 18, 22 is substantially rectangular in shape and extends between a first end 32 and a second end 34 of the luminaire 10. The axes 16, 20, 24 are oriented parallel to one another.

In the illustrated embodiment, each portion 14, 18, 22 is laterally spaced apart from the other two portions. In other words, none of the portions 14, 18, 22 are directly fixed to each other. The first portion 14 is disposed on one side of the luminaire 10 and the second portion 18 is disposed on another side of the luminaire, such that the first portion 14 and the second portion 18 are spaced apart from one another. The third portion 22 is disposed between the first and second portions 14, 18. The third portion 22 is spaced apart from the first and second portions 14, 18, and a gap 26 is disposed between the third portion 22 and the first portion 14 and another gap 26 is disposed between the third portion 26 and the second portion 18.

Figure 4:
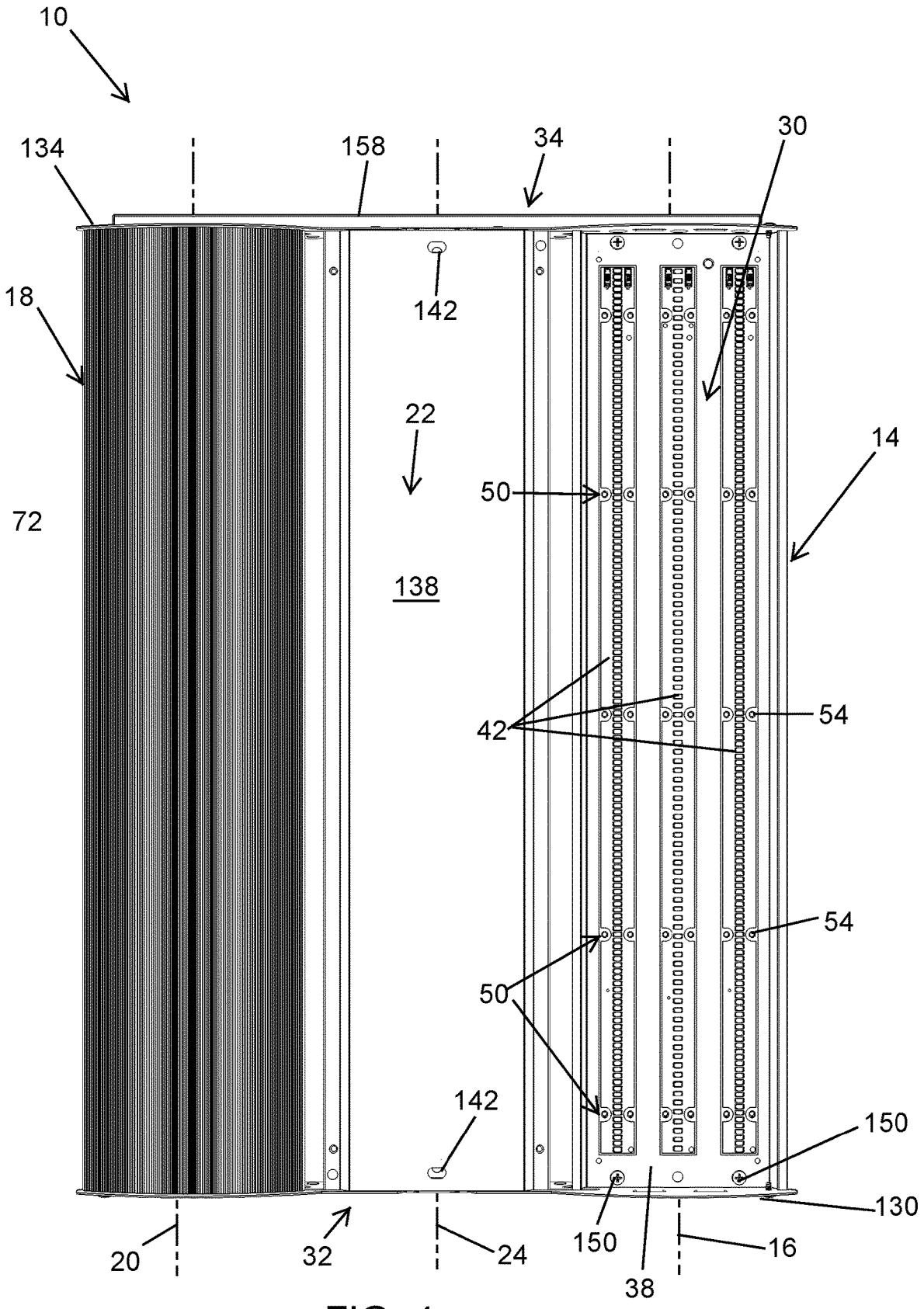
FIG. 4 is a lower view of the luminaire of FIG. 1A with one lens removed.

As shown in FIG. 4, the first portion 14 includes a channel 30 that extends along the axis 16. In the illustrated embodiment, the channel 30 extends substantially between the first end 32 and the second end 34 of the luminaire 10. The channel 30 is defined by a support surface 38 and two side surfaces 40. The support surface 38 is disposed between the side surfaces 40 so that the side surfaces 40 are spaced apart from one another. In the illustrated embodiment, the support surface 38 is substantially rectangular in shape and extends along the axis 16. Each side surface 40 extends the length of the support surface 38 along the axis 16.

Figure 6:
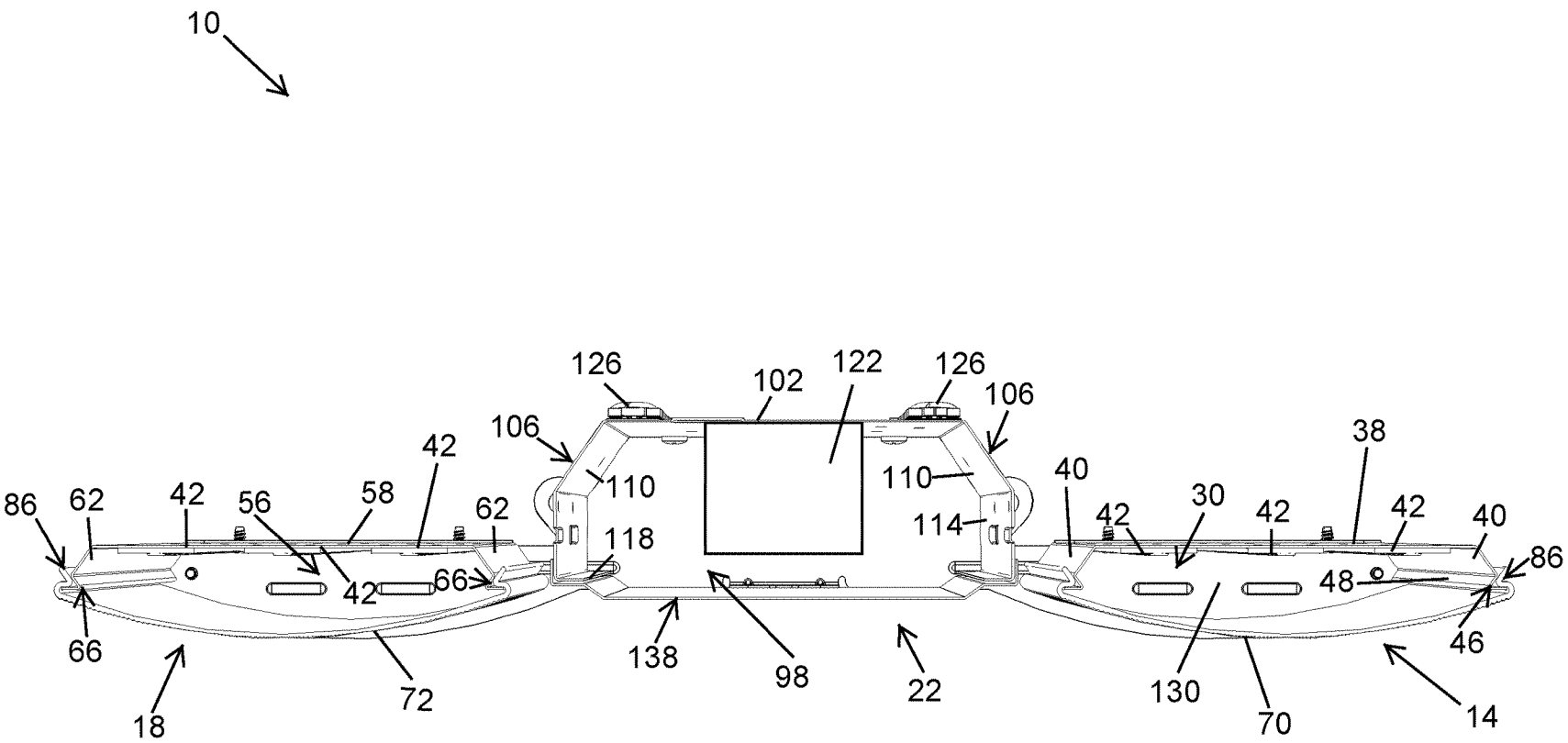
FIG. 6 is a cross-sectional view of the luminaire of FIG. 1A, viewed along section 6-6.

As shown in FIG. 6, each side surface 40 is oriented obliquely with respect to the support surface 38. In the illustrated embodiment, the side surfaces 40 are oriented at an obtuse angle with respect to the support surface 38. In other words, the side surfaces 40 are inclined away from the axis 16 (FIG. 1). The side surfaces 40 are substantially rectangular in shape and include a pocket 46 that opens away from the channel 30 (i.e., an opening to the pocket 46 faces away from the channel 30). In other embodiments, the openings of the pocket 46 may face the channel 30. Faces of the pockets 46 are inclined with respect to the side surfaces 40. A first face 47 is substantially parallel with respect to the support surface 38 and a second surface 48 is inclined with respect to the support surface 38.

Returning to FIG. 4, light emitting devices 42 are coupled to the support surface 38. In the illustrated embodiment, the light emitting devices 42 are light emitting diodes (LEDs). In the illustrated embodiment, the LEDs 42 are aligned in strips. In other words, an elongated strip of electrically and mechanically connected LEDs are coupled to the support surface 38 and extend in a direction parallel to the axis 16. In the illustrated embodiment, three strips of LEDs 42 are coupled to the support surface 38 within the first portion 14; although in other embodiments, fewer or more LED strips 42 may be coupled to the support surface 38. Each LED strip 42 includes holes 50 which receive fastening members 54 (e.g., threaded screws). The fastening members 54 removably couple each LED strip 42 to the support surface 38.

As shown in FIGS. 4 and 6, the second portion 18 is substantially similar to the first portion 14. The second portion 18 includes a channel 56 defined by a support surface 58 and side surfaces 62, which are oriented in a substantially similar manner as the support surface 58 and the side surfaces 62. Each side surface 62 includes a pocket 66 that opens away from the channel 56 (i.e., an opening to the pocket 66 faces away from the channel 56); although in other embodiments, the openings of the protrusions may face the channel 56.

LED strips 42 are coupled to the support surface 58 of the second portion 18. In the illustrated embodiment, an equivalent number of LED strips 42 are coupled to the support surface 58 and the support surface 38 (e.g., three LED strips 42). Although in other embodiments, fewer or more LED strips 42 may be coupled to the support surface 58, and fewer or more LED strips may be positioned on the support surface 58 of the second portion 18 than the support surface 38 of the first portion 14.

As shown in FIG. 6, a first lens 70 is coupled to the first portion 14 and a second lens 72 is coupled to the second portion 18. The lenses 70, 72 are substantially similar in shape and the first lens 70 may be coupled to the second portion 18 and the second lens 72 may be coupled to the first portion 14. In the illustrated embodiment, the lenses 70, 72 have a curved profile with a smooth internal face proximate the channel 30, 56 and a ridged outer face proximate an external environment.

The lenses 70, 72 include a bent portion 86 disposed on either side of the lenses 70, 72. In the illustrated embodiment, the bent portions 86 are formed as protuberances that bend outwardly, toward the external environment. The pockets 46, 66 are substantially similar in shape to the protuberances 86, which allows one of the pockets 46, 66 to engage or nest with one of the associated protuberances 86. Each lens 70, 72 snaps onto one of the portions 14, 18.

Contact between the pockets 46, 66 and the respective surfaces of the protuberances 86 limit movement of the lens 70, 72 relative to the portion 14, 18 in directions that are non-parallel to the axes 16, 20 (e.g., in a vertical direction as shown in FIG. 6). In the illustrated embodiment, the nesting arrangement forces direct contact between the pockets 46, 66 and the respective surfaces of the protuberances 86 while the lens 70, 72 is coupled to the respective portion 14, 18. The pockets 46, 66 and protuberances 86 directly contact each other and engage each other, e.g., by a snap-fit.

The snap fit between the lens 70, 72 and the portion 14, 18 facilitates quick coupling of the lenses 70, 72 and portions 14, 18 together. A user may also remove the lens 70, 72 by applying a force proximate either bent portion 86 of the lens 70, 72 to move the bent portion 86 away from the pocket 46, 66, thereby allowing the lens 70, 72 to be separated from the respective portion 14, 18.

As shown in FIGS. 4 and 6, the third portion 22 includes a channel 98 that extends along the axis 24. In the illustrated embodiment, the channel 98 extends substantially between the first end 32 and the second end 34 of the luminaire 10. The channel 98 is defined by a support surface 102 and two side surfaces 106. The support surface 102 is disposed between the side surfaces 106 so that the side surfaces 106 are spaced apart from one another. The support surface 102 is substantially rectangular in shape and extends along the axis 24. Each side surface 106 extends the length of the support surface 102 along the axis 24.

Light emitting devices 126 are coupled to the support surface 102 and disposed in an external environment (i.e., the light emitting devices 126 and the control housing 122 are coupled to opposite faces of the support surface 102). The light emitting devices 126 are light emitting diodes (LEDs). The light emitting devices 126 on the support surface 102 provide uplighting in a direction opposite the light output from the first portion 14 and the second portion 18. In the illustrated embodiment, the LEDs 126 are aligned in strips. In other words, an elongated strip of electrically and mechanically connected LEDs are coupled to the support surface 102 and extend in a direction parallel to the axis 24. In the illustrated embodiment, four strips of LEDs 126 are coupled to the support surface 102; although in other embodiments, fewer or more LED strips 126 may couple to the support surface 102. Each LED strip 126 receives fastening members (e.g., threaded screws—not shown). The fastening members removably couple each LED strip 126 to the support surface 102.

As shown in FIG. 6, the side surfaces 106 include an oblique portion 110, an orthogonal portion 114, and a parallel portion 118. Each of the portions 110, 114, 118 is substantially planar surfaces. The oblique portion 110 is adjacent the support surface 102 and is disposed obliquely with respect to the support surface 102. The orthogonal portion 114 is adjacent the oblique portion 110 and disposed orthogonally with respect to the support surface 102, and obliquely with respect to the oblique portion 110. The parallel portion 118 is adjacent the orthogonal portion 102 and is disposed parallel with respect to the support surface 102 and orthogonally with respect to the orthogonal surface 114.

Figure 9:
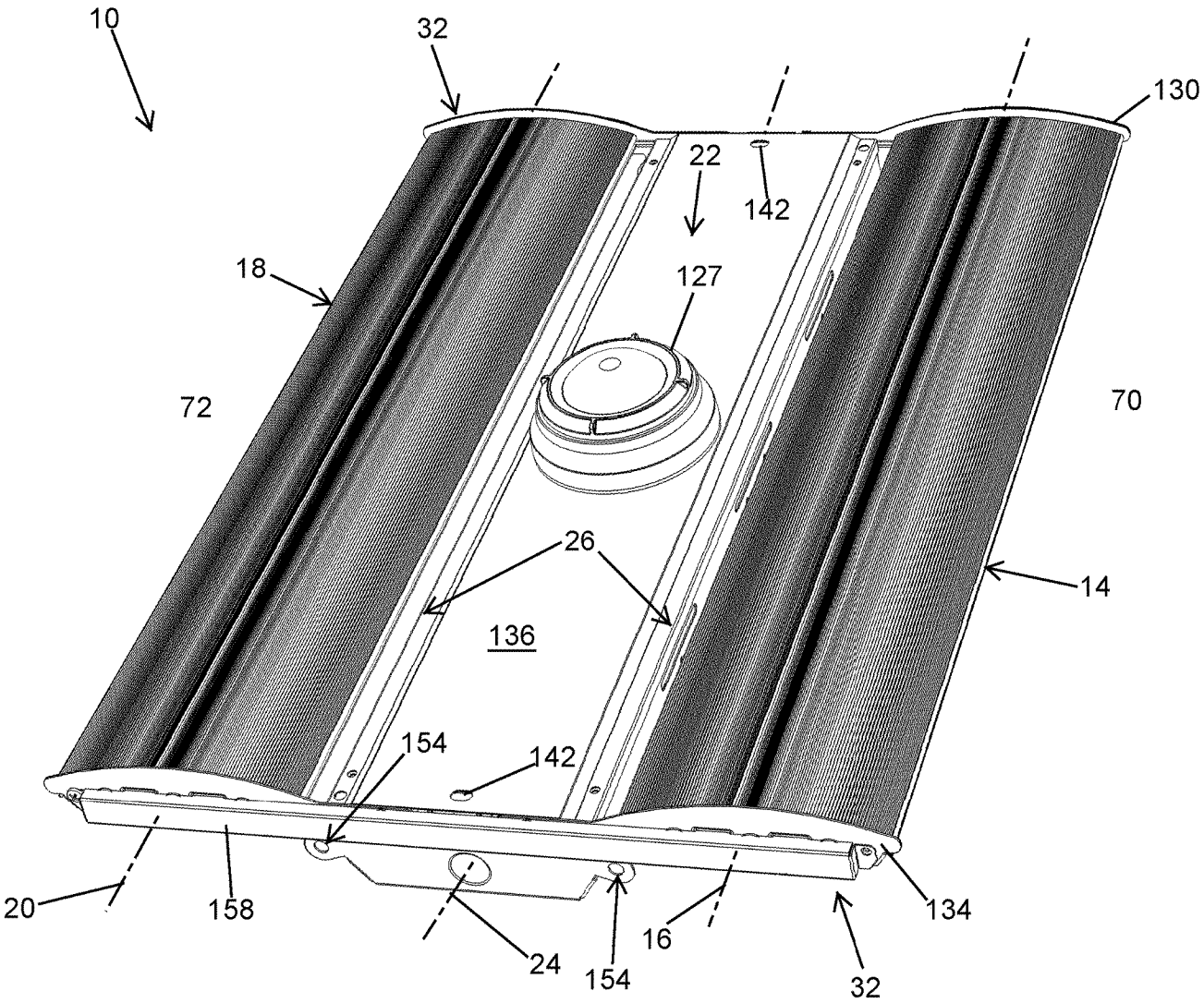
FIG. 9 is a perspective view of the luminaire of FIG. 1A including a sensor.

A control housing 122 is coupled to the support surface 102 and disposed within the channel 98. The control housing 122 houses various control elements (not shown) that are in electrical communication with each other and/or electrical elements disposed outside of the control housing 122. For example, the control elements are in electrical communication with the LEDs 126. The control elements may also sensors 127 (e.g., motion sensors or occupancy sensors), which may be positioned on the luminaire 10 (FIG. 9). The sensors 127 may be positioned at various locations on the luminaire 10, including on a cover 138 of the third portion 22. Sensors 127 may also be coupled to an end cap 130, 134, for example, protruding from the end cap away from the third portion. The control elements may include current control, which drives a current output by the control elements.

The cover 138 is coupled to the third portion 22 proximate the parallel portions 118 and encloses the control housing 122. The cover 138 is removable from the lower surface of the third portion 22, facilitating access to the components in the third portion 22 for servicing or replacement purposes. A fastening member 142 is disposed at either end of the third portion 22 (i.e., proximate the first end 32 and the second end 34) and is used to couple the cover 138 to the third portion 22. In the illustrated embodiment, the fastening members 142 are quarter-turn screws. Each quarter-turn screw 142 is rotatable ninety degrees between a lock position (i.e., where the cover 138 is coupled to the third portion 22) and an unlocked position (i.e., where the cover 138 is decoupled from the third portion 22).

Figure 3:
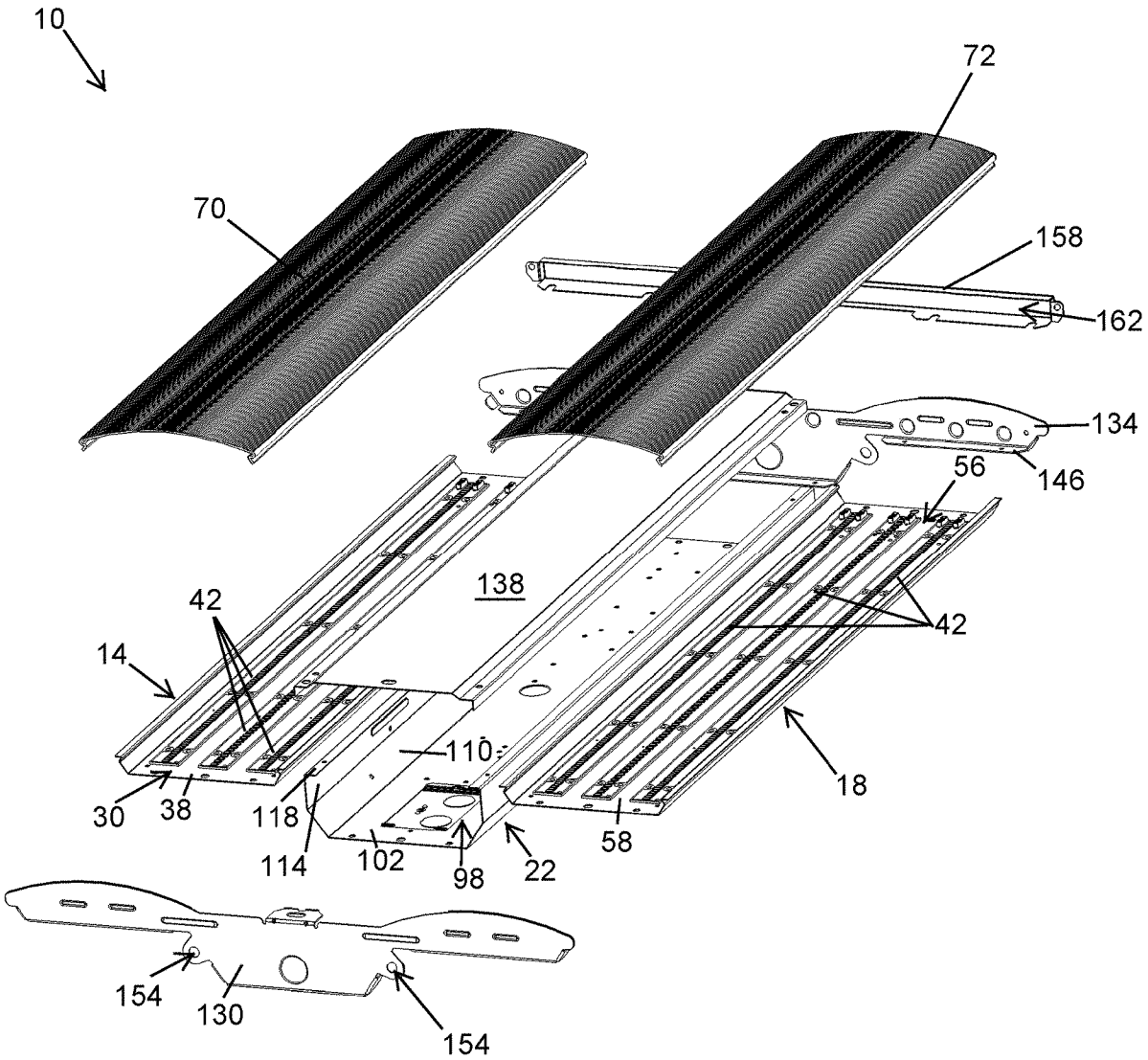
FIG. 3 is an exploded view of the luminaire of FIG. 1A.

As described above and illustrated in FIG. 3, each portion 14, 18, 22 is an independent body. Two end caps 130, 134 are coupled to each of the portions 14, 18, 22. In the illustrated embodiment, the portions 14, 18, 22 are disposed such that the respective support surfaces 38, 58, 102 are oriented in substantially the same direction. The first end cap 130 is coupled to the first end 32 of the luminaire 10. The second end cap 134 is coupled to the second end 34 of the luminaire 10. Each end cap 130, 134 includes a substantially similar profile as the combination of the three portions 14, 18, 22 (i.e., sides of the end caps 130, 134 have a similar shape to the lenses 70, 72 coupled to the first or second portions 14, 18 and a middle has a similar shape to the three portions 110, 114, 118 (FIG. 6).

Figure 5:
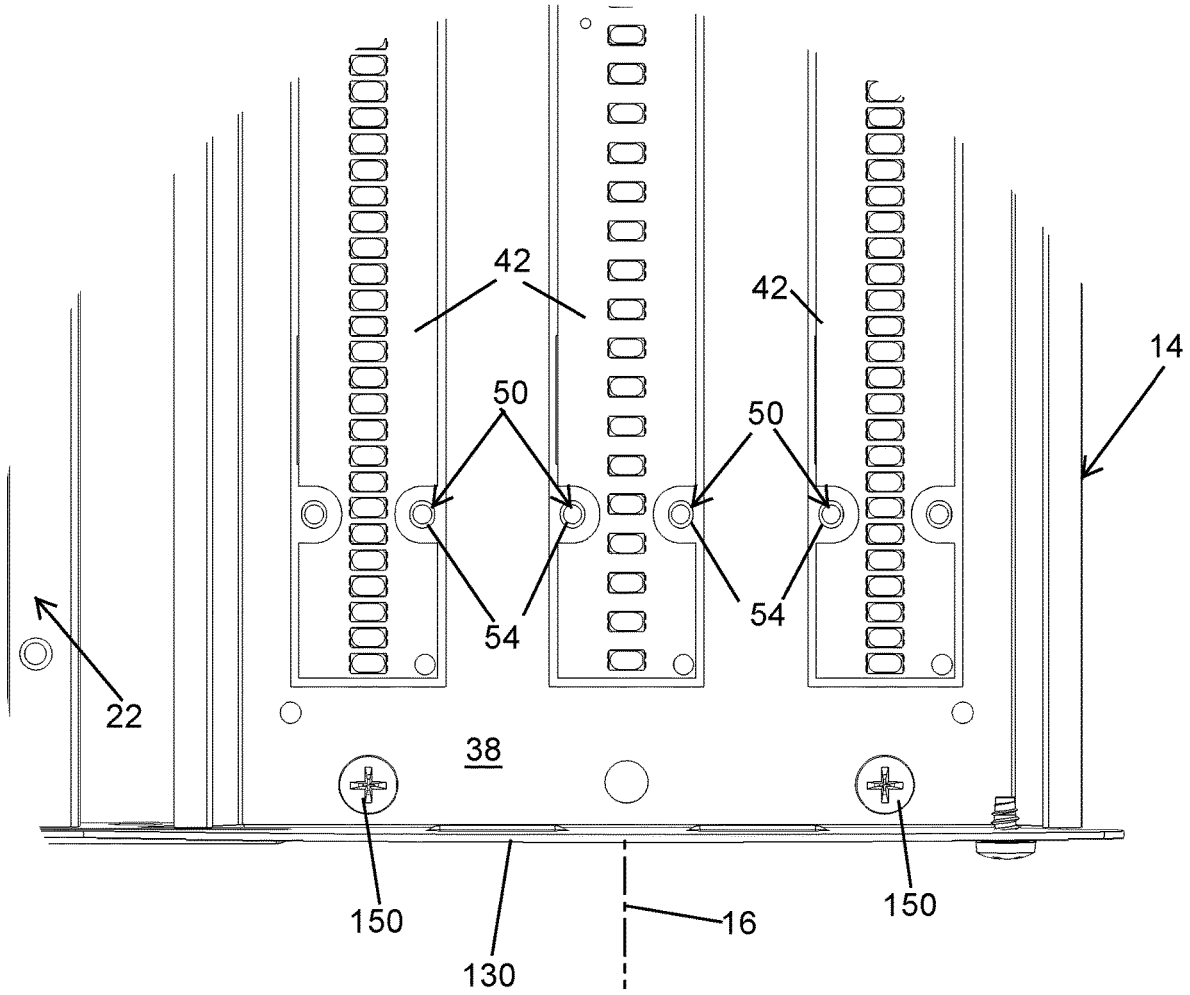
FIG. 5 is an enlarged view of FIG. 4, illustrating light emitting devices.

One edge of the end caps 130, 134 includes flanges 146. Each portion 14, 18, 22 is positioned in a respective location of the end caps 130, 134 (i.e., the third portion 22 is positioned in the middle of the end caps 130, 134 and the first and second portions 14, 18 are positioned on the sides). The flanges 146 abut the portions 14, 18, 22 on surfaces opposite the support surfaces 38, 58, 102 proximate the channels 30, 56, 98 (i.e., the flanges 146 are external to the channels). Fastening members (e.g., threaded screws) 150 (FIG. 5) extend through the flanges 146 and the respective support surfaces 38, 58, 102 so that the end caps 130, 134 are coupled to each portion 14, 18, 22 (FIG. 5).

Figure 7A:
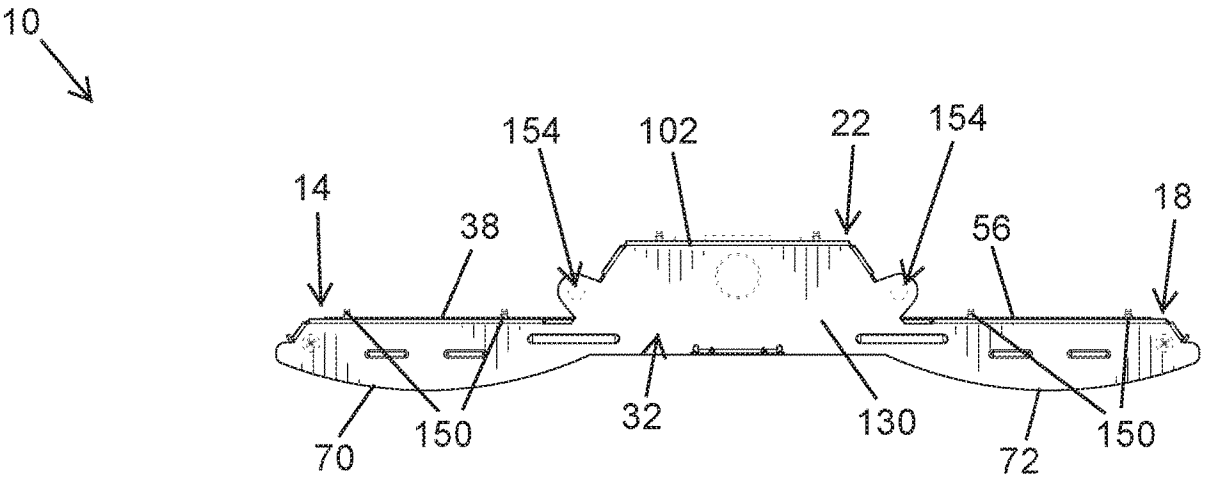
FIG. 7A is a first end view of the luminaire of FIG. 1A

As shown in FIG. 7A, the end caps 130, 134 include apertures 154 oriented parallel to the axes 16, 20, 24 while the end caps 130, 134 are coupled to the portions 14, 18, 22. In the illustrated embodiment, each end cap 130, 134 includes two apertures 154 disposed proximate the third portion 22. One aperture 154 is disposed on each side of the third portion 22.

Figure 7B:
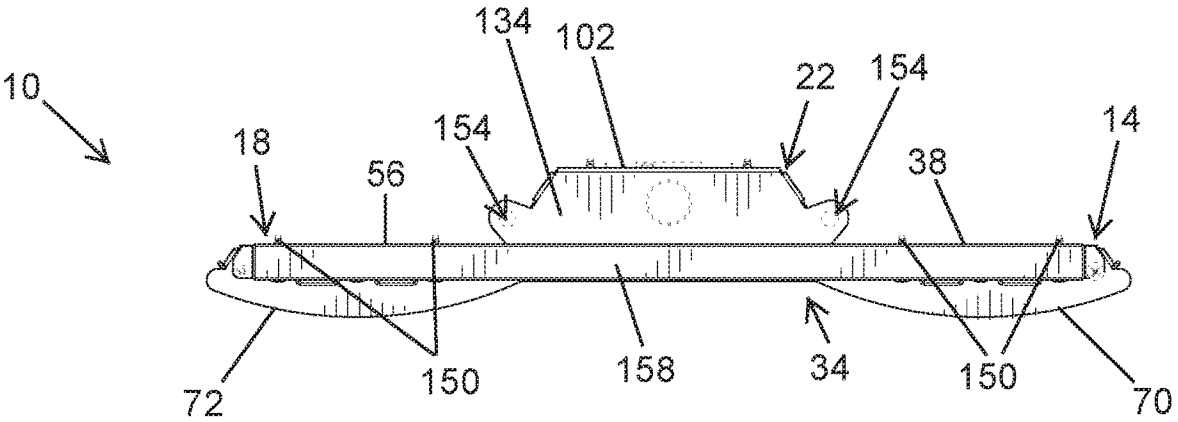
FIG. 7B is a second end view of the luminaire of FIG. 1A.

As shown in FIG. 7B, a bracket 158 is coupled to the end cap 134. The bracket 158 is substantially rectangular in shape and extends orthogonally with respect to the axes 16, 20, 24 while the end cap 134 is coupled to the portions 14, 18, 22. The bracket 158 includes a passage 162 (FIG. 3) that extends the length of the bracket 158. Electrical wiring (not shown) extends from the control housing 122 (FIG. 6) in the third portion 22 into the passage 162. The wiring travels through the passage 162 to the channel 38 of the first portion 14 and to the channel 58 of the second portion 18. The wiring to provide current to the LEDs in both the first portion 14 and the second portion 18 is provided from one end of the fixture 10, simplifying assembly and servicing. The wiring electrically connects to the LEDs 42 and provides the LEDs 42 with a source of electrical current. The control elements disposed in the control housing 122 may control other aspects of the LEDs 42 (e.g., on/off controls, brightness controls, color hue controls).

Figure 18:
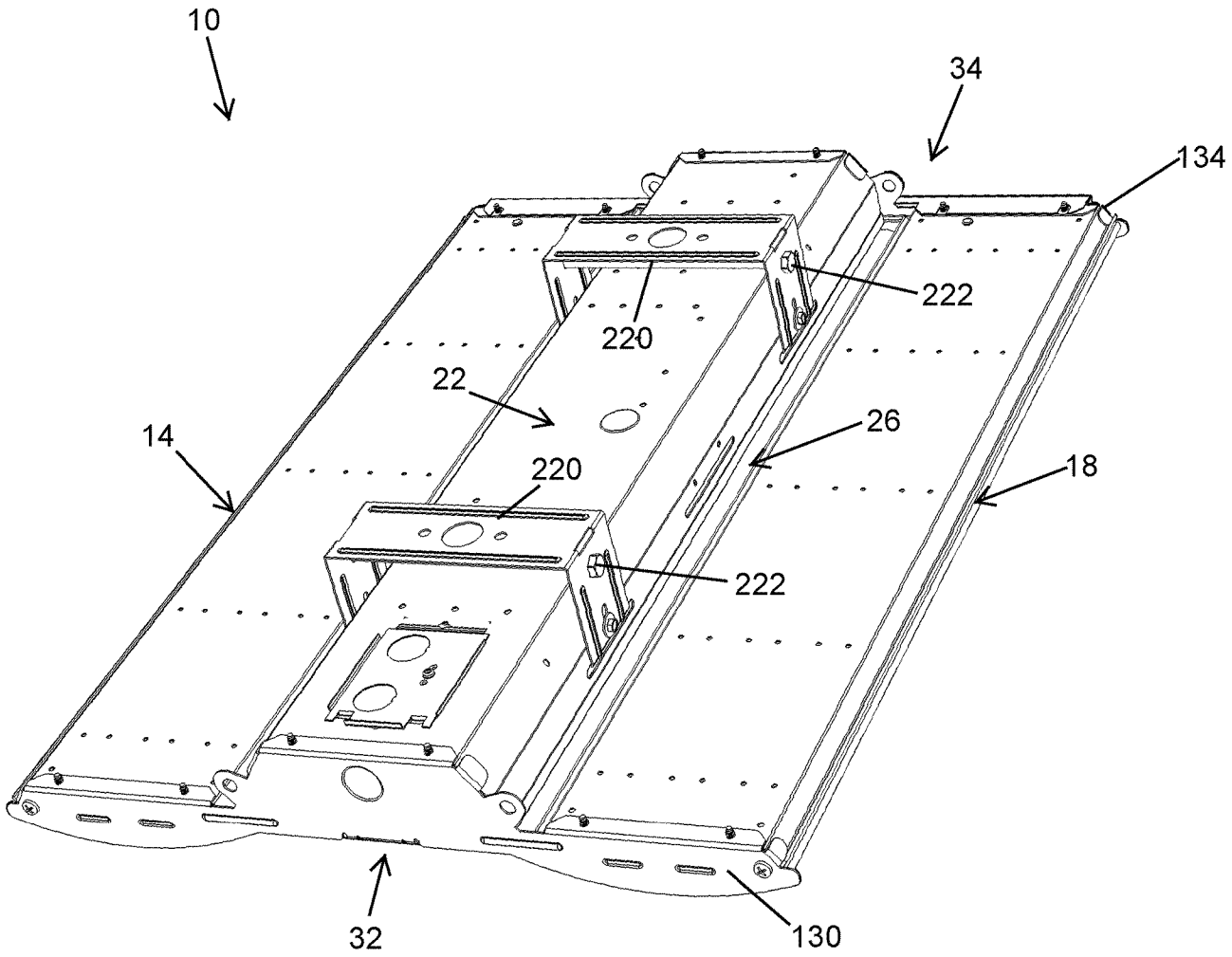
FIG. 18 is an upper perspective view of a luminaire including brackets.

The luminaire 10 is a low-profile light fixture (e.g., a high bay light fixture) and is configured to be suspended from an elevated surface or ceiling (not shown). Cables (not shown) may extend through apertures 154 and can be anchored to the ceiling in order to secure the luminaire 10 to the ceiling. In other embodiments, such as FIG. 18, brackets 220 can be coupled to the luminaire 10 proximate the support surface 102. Fasteners 222 (e.g., threaded screws—FIG. 18) may be received through the bracket 220 to couple the luminaire 10 to the ceiling. In the embodiment of FIG. 18, two brackets 220 engage slots on sides of the third portion 22. In other embodiments, fewer or more brackets 220 may support the luminaire 10.

While coupled to the ceiling, the luminaire 10 is oriented so that the lenses 70, 72 face the floor. Light emitted from the LEDs 42 passes through the respective lenses 70, 72 and into a room. In some embodiments, the body of the luminaire 10 includes a gloss finish to improve surface reflectivity. The lenses 70, 72 can include prisms (not shown) to allow for narrow or wide light distribution. The LEDs 126 are oriented toward an opposite direction from the LEDs 42

(i.e., toward the ceiling). The LEDs 126 provide an up-light and illuminate the ceiling to avoid shadows and dark spots on the ceiling.

The quarter-turn screws 142 and the snap-fit lenses 70, 72 allow a user to easily access each portion 14, 18, 22 independently once the luminaire 10 has been mounted to the ceiling. The bracket 158 stores all of the wiring in a single passage 162 to provide a clean look to the luminaire 10.

Figure 8:
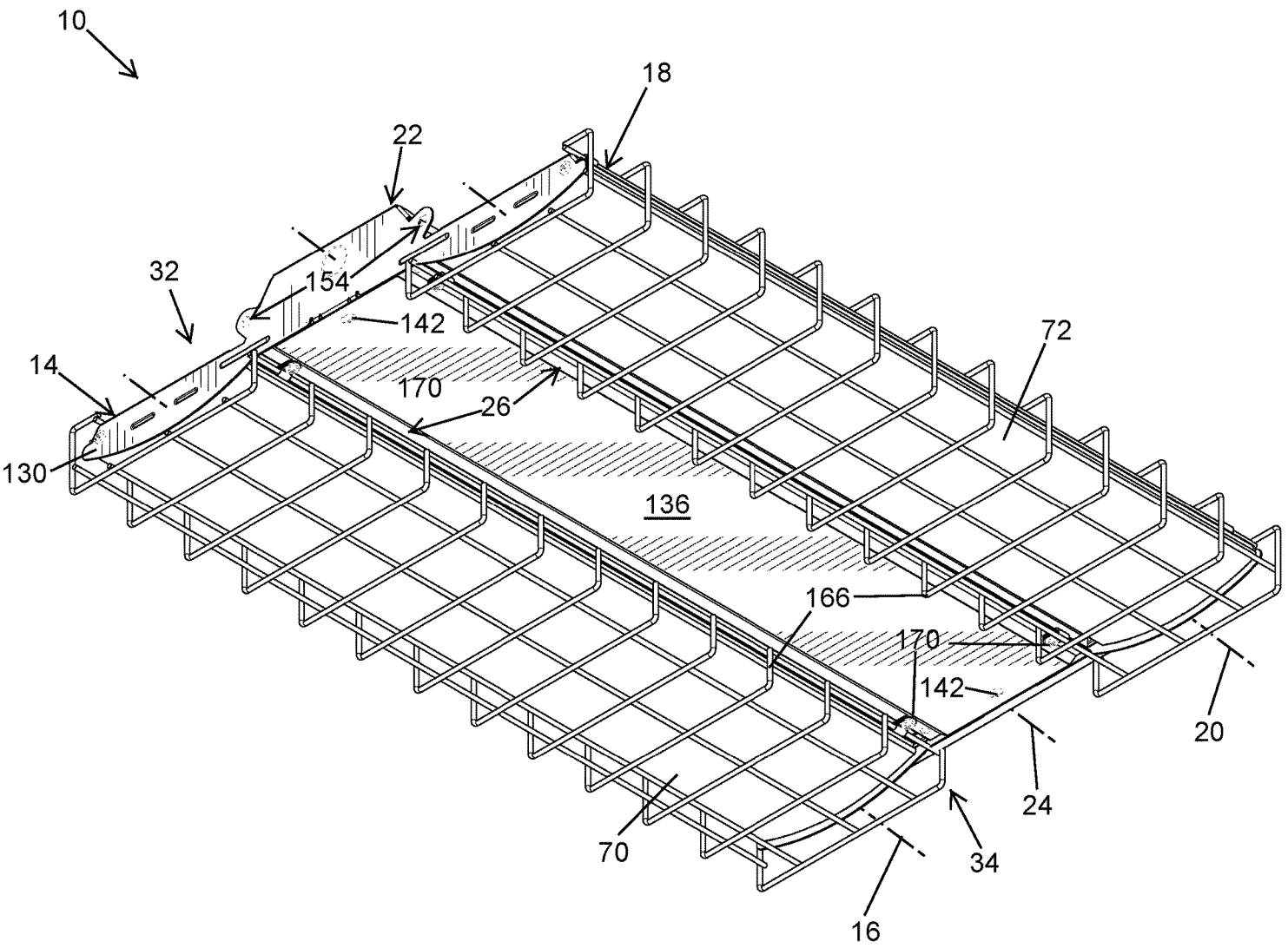
FIG. 8 is a perspective view of the luminaire of FIG. 1A including a wire guard.

As shown in FIG. 8, in some embodiments a cage or wire guard 166 can be positioned around one or both lenses 70, 72. In the illustrated embodiment, one wire guard 166 is disposed around the first lens 70 and one wire guard is disposed around the second lens 72, allowing each wire guard 166 to be removed independently of the other wire guard 166. The wire guards 166 couple to opposite sides of the luminaire 10. Fastening brackets 170 of the wire guards 166 are coupled to the cover 138 as well as the support surfaces 38, 58. The wire guards 166 provide protection for the lenses 70, 72.

Figure 10:
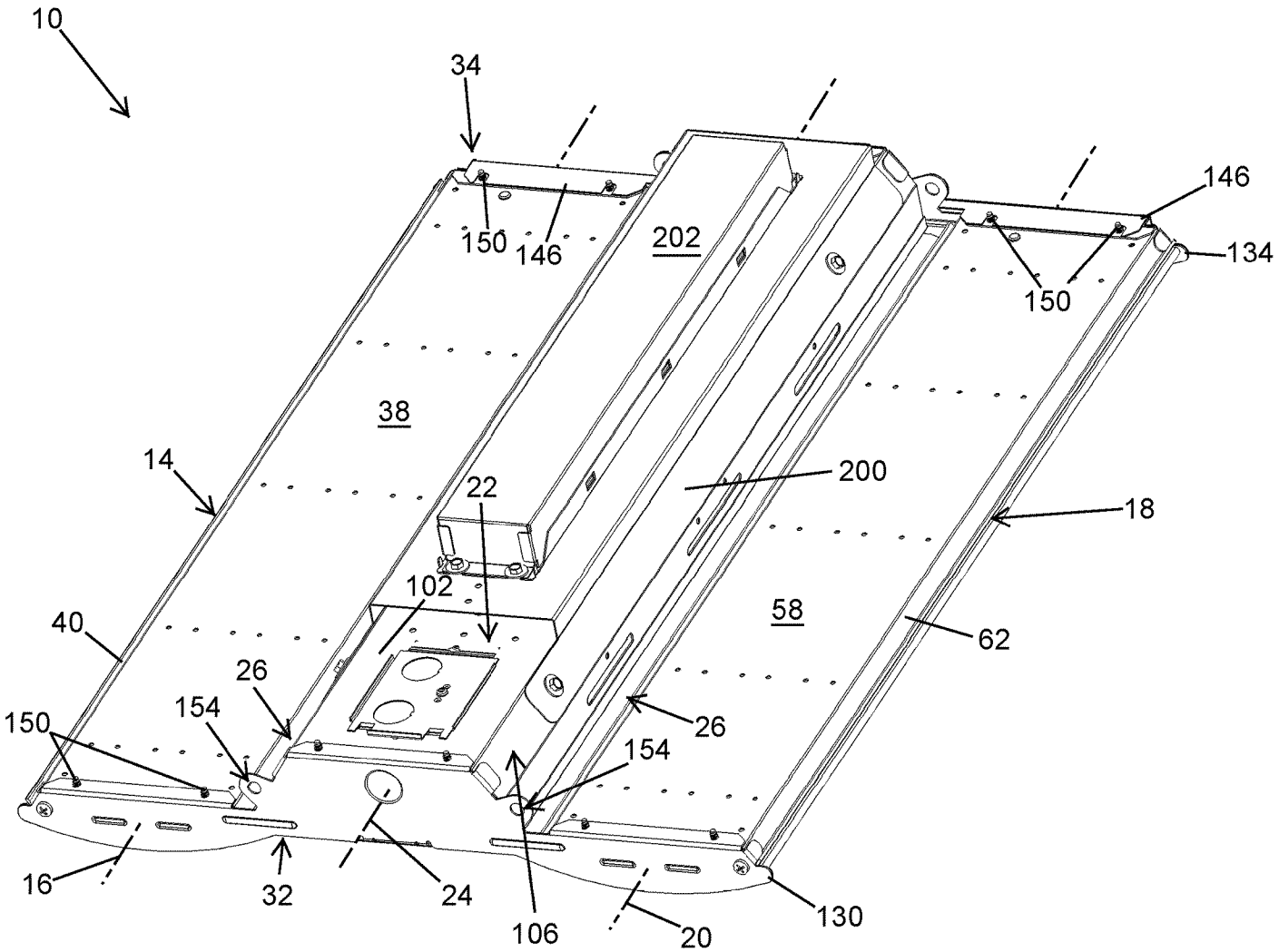
FIG. 10 is a perspective view of a luminaire of 1A including a battery.

As shown in FIG. 10, in some embodiments a back pan 200 is coupled to the side surfaces 106 of the third portion 22. In the illustrated embodiment, the back pan 200 is spaced apart from the support surface 102. A battery 202 is coupled to the back pan 200. The battery 202 supplies electrical energy to the control housing 122 (FIG. 6). In some embodiments, the battery 202 may be a battery back-up, while in other embodiments, the battery may be the control housing's 122 only supply of electrical energy.

Figure 11:
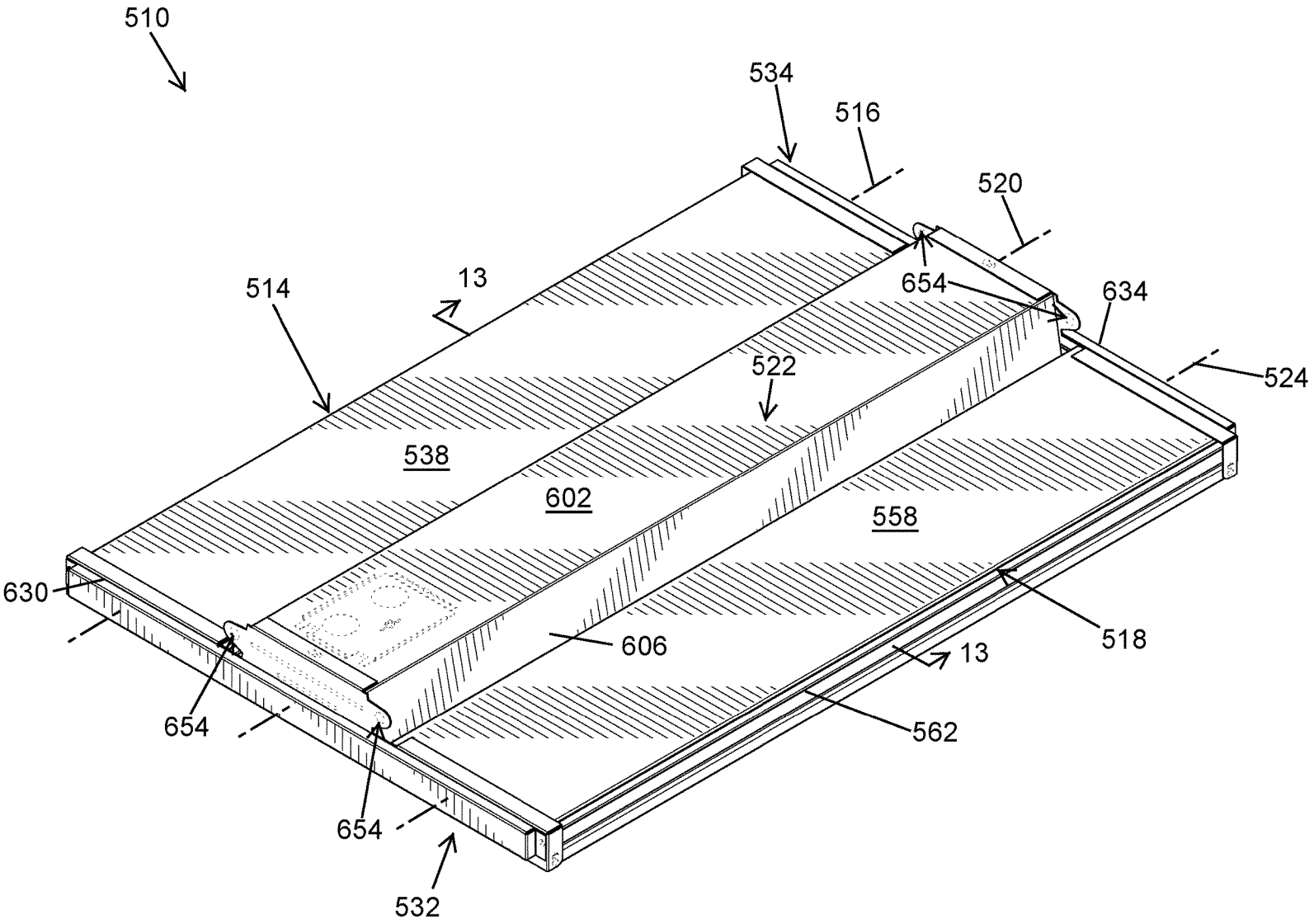
FIG. 11 is a perspective view of a luminaire according to another embodiment.
Figure 12:
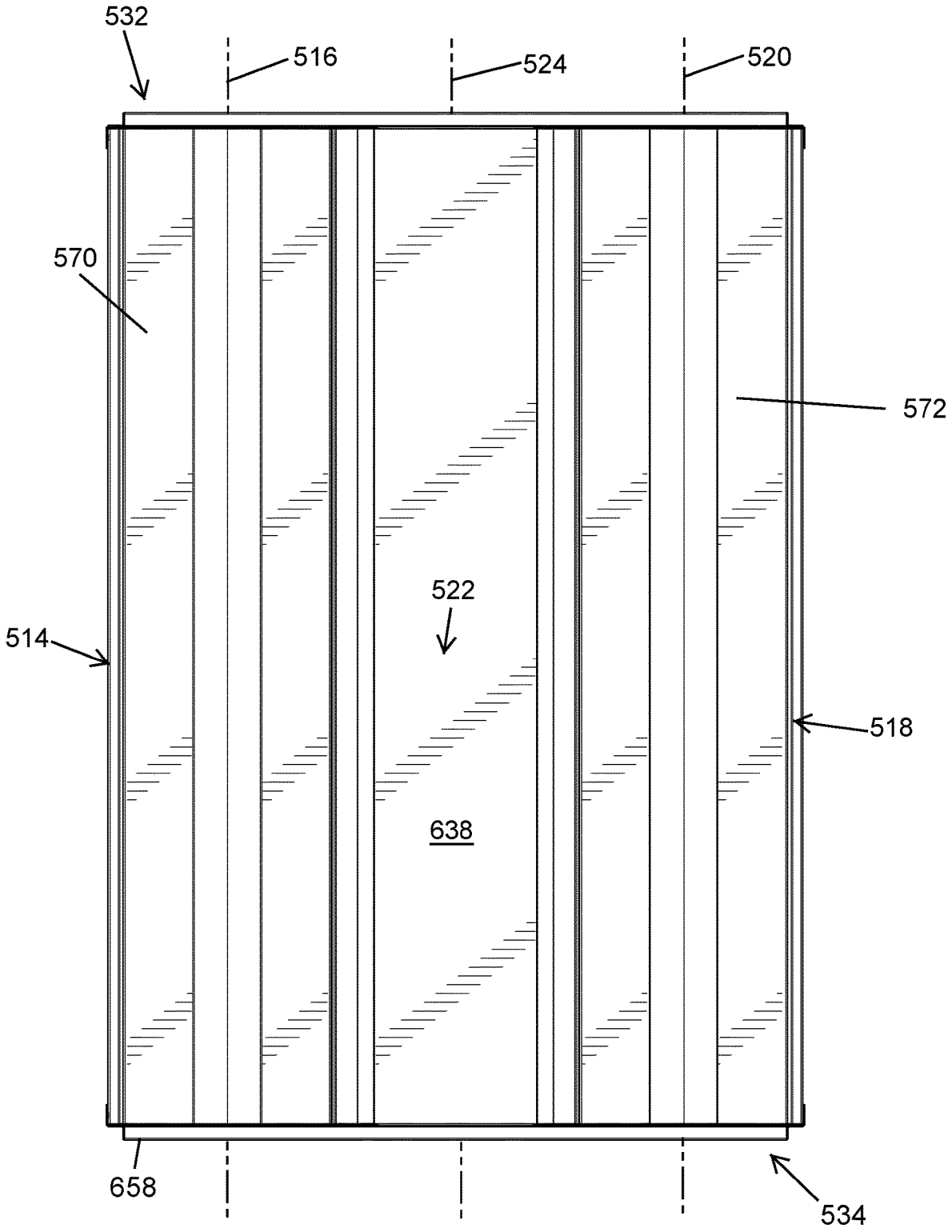
FIG. 12 is a lower view of the luminaire of claim 11.
Figure 13:
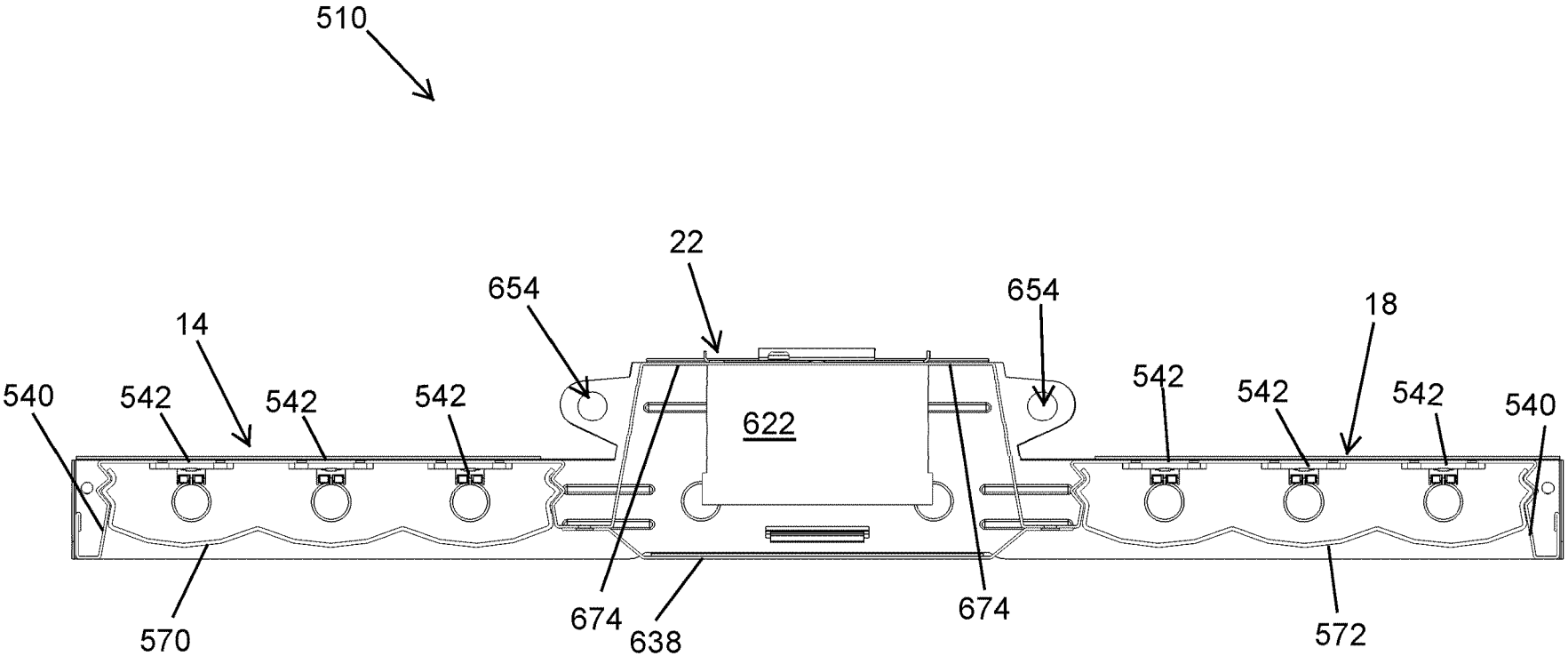
FIG. 13 is a cross-sectional view of the luminaire of FIG. 11, viewed along section 13-13.
Figure 14:
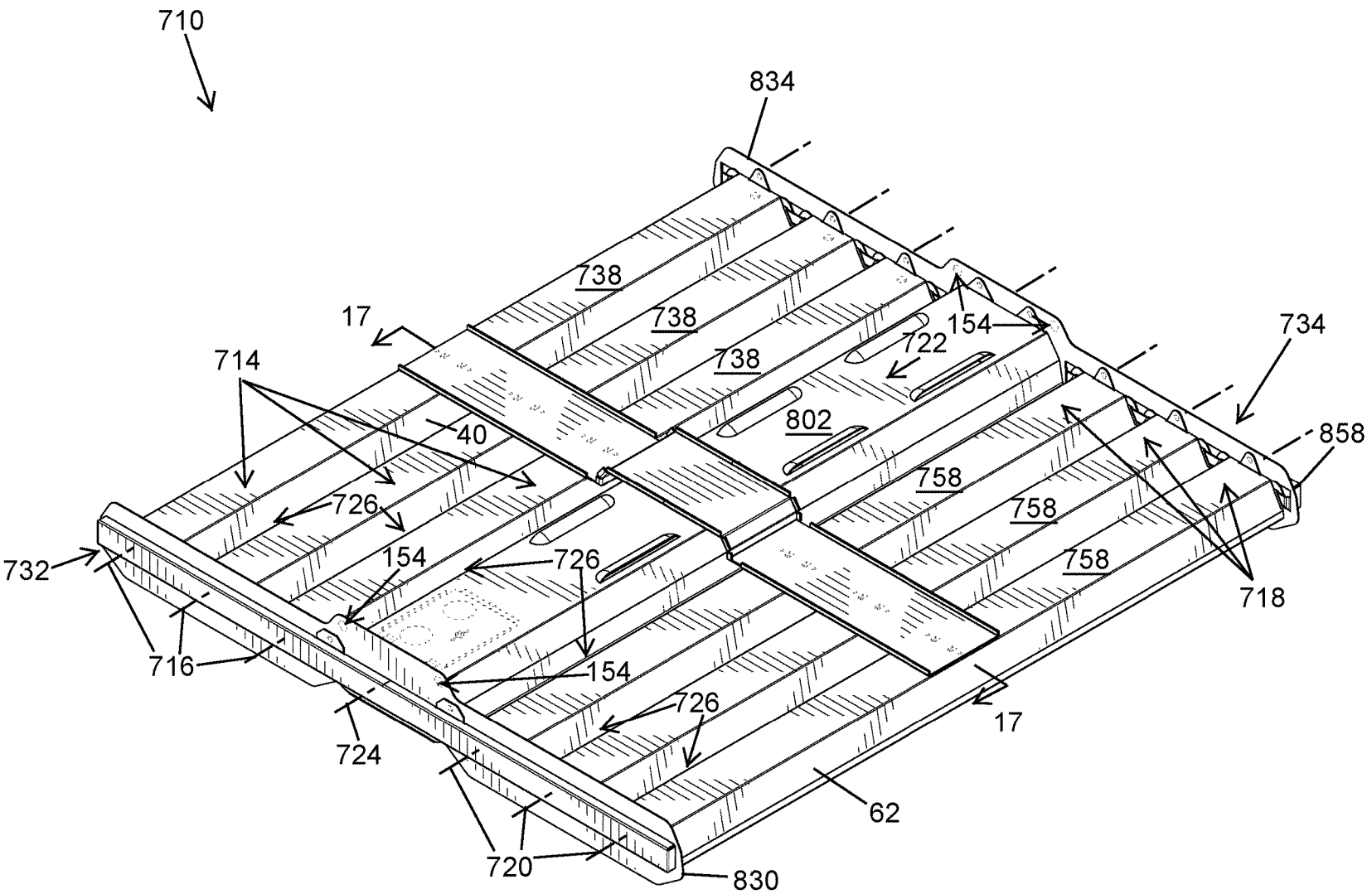
FIG. 14 is an upper perspective view of a luminaire according to another embodiment.

FIGS. 11-13 illustrate a luminaire 510 according to another embodiment. At least some differences and similarities between luminaire 510 and luminaire 10 are described below. Similar features are identified with similar reference numbers, plus 500.

As shown in FIGS. 11-13, the luminaire 510 includes distinct portions, channels, or trays. In the illustrated embodiment, the luminaire 510 includes a first portion 514 extending along a first axis 516, a second portion 518 extending along a second axis 520, and a third portion 522 extending along a third axis 524. Each of the portions 514, 518, 522 is substantially rectangular in shape and extends between a first end 532 and a second end 534 of the luminaire 510. Each axes 516, 520, 524 is parallel with respect to the other axes.

The first portion 514 is disposed on one side of the luminaire 510 and the second portion 518 is disposed on another side of the luminaire 510, such that the first portion 514 and the second portion 518 are spaced apart from one another. The third portion 522 is disposed between the first and second portions 514, 518. The third portion 522 is adjacent to the first and second portions 514, 518. In the illustrated embodiment, the first, second, and third portions 514, 518, 522 are formed as a unitary piece of material.

As shown in FIG. 13, each portion 514, 518, 522 has a substantially U-shape with a support surfaces 538, 558, and 602 respectively. LEDs 542 are coupled to the support surfaces 538, 558. In the illustrated embodiment, three strips of LEDs 542 are coupled to the each support surface 538, 558. Two side surfaces 540, 562, 606 extend from each support surface 538, 558, 602 respectively. A control housing 622 is coupled to the support surface 602 and houses various control elements (not shown) that are in electrical communication with each other and/or electrical elements disposed outside of the control housing 622. For example, the control elements are in electrical communication with the LEDs 626. The control elements may include current control, which drives a current output by the control elements.

The side surfaces 540, 562 include pockets 546, 566 that receive protuberances 586 from a lens 570, 572. The protuberances 586 nest within the pockets 546, 566 is a substantially similar manner as described above with regard to the luminaire 510 and are not repeated here for the sake of brevity. In the illustrated embodiment, the lenses 570, 572 fit within the respective portions 514, 518 so that substantially the entire lens 570, 572 is received within the respective portion 514, 518.

A planar surface 674 extends between third portion 522 and each of the first and second portions 514, 518. A cover 638 is positioned on the planar surfaces 674 such that planar surfaces of the cover 638 abut the planar surfaces 674. The cover 638 is removable from the lower surface of the third portion 522, facilitating access to the components in the third portion 522 for servicing or replacement purposes. As shown in FIG. 10, fasteners 642 are disposed proximate the first end 532 and the second end 534 of the luminaire 510. In the illustrated embodiment, the fasteners 642 are quarter-turn screws. Each quarter-turn screw 642 is rotatable ninety degrees between a lock position (i.e., where the cover 638 is coupled to the third portion 522) and an unlocked position (i.e., where the cover 638 is decoupled from the third portion 522).

Two end caps 630, 634 are coupled to each of the portions 514, 518, 522. in the illustrated embodiment, the portions 514, 518, 522 are disposed such that the respective support surfaces 538, 558, 602 are oriented in substantially the same direction. The first end cap 630 is coupled to the first end 532 of the luminaire 510. The second end cap 634 is coupled to the second end 534 of the luminaire 510. Each end cap 530, 534 includes a substantially similar profile as the combination of the three portions 514, 518, 522.

As shown in FIG. 11, a bracket 658 is coupled to the end cap 634. The bracket 658 is substantially rectangular in shape and extends orthogonally with respect to the axes 516, 520, 524 while the end cap 634 is coupled to the portions 514, 518, 522. The bracket 658 includes a passage (not shown) that extends the length of the bracket 658. Electrical wiring (not shown) extends from the control housing 622 (FIG. 13) in the third portion 522 into the passage. The wiring travels through the passage to the first portion 514 and to the second portion 518. The wiring to provide current to the LEDs in both the first portion 514 and the second portion 518 is provided from one end of the fixture 510, simplifying assembly and servicing. The wiring electrically connects to the LEDs 542 and provides the LEDs 542 with a source of electrical current. The control elements disposed in the control housing 622 may control other aspects of the LEDs 542 (e.g., on/off controls, brightness controls, color hue controls).

The luminaire 510 is a low profile high bay light and is configured to be suspended from an elevated surface or ceiling (not shown). Cables (not shown) may extend through apertures 654 and anchor into the ceiling in order to secure the luminaire 510 to the ceiling. In other embodiments, brackets (not shown) may be coupled to the luminaire 510 proximate the support surface 602. Fasteners (e.g., threaded screws—not shown) may be received through the bracket to couple the luminaire 510 to the ceiling.

While coupled to the ceiling, the luminaire 510 is oriented so that the lenses 570, 572 face the floor. Light emitted from the LEDs 542 passes through the respective lenses 570, 572 and into a room. In some embodiments, the body of the luminaire 510 includes a gloss finish to improve surface reflectivity. The lenses 570, 572 can include prisms (not shown) to allow for narrow or wide light distribution. LEDs 626 are coupled to an outer surface of the third portion 522 oriented toward an opposite direction from the LEDs 542 (i.e., toward the ceiling). The LEDs 626 provide an up-light and illuminate the ceiling to avoid shadows and dark spots on the ceiling.

The quarter-turn screws 642 and the snap-fit lenses 570, 572 allow a user to easily access each portion 514, 518, 522 independently once the luminaire 510 has been mounted to the ceiling. The bracket 658 stores all of the wiring in a single passage to provide a clean look to the luminaire 510.

FIGS. 14-17 illustrate a luminaire 710 according to another embodiment. At least some differences and similarities between luminaire 710 and luminaire 10 are described below. Similar features are identified with similar reference numbers, plus 700.

As shown in FIGS. 14-17, the luminaire 710 includes distinct portions, channels, or trays. In the illustrated embodiment, the luminaire 710 includes three first portions 714 extending along a first axis 716, three second portions 718 extending along a second axis 720, and a third portion 722 extending along a third axis 724. Each of the portions 714, 718, 722 is substantially rectangular in shape and extends between a first end 732 and a second end 734 of the luminaire 710. Each axes 716, 720, 724 is parallel with respect to the other axes.

In the illustrated embodiment, each portion 714, 718, 722 is laterally spaced apart from the other portions. In other words, none of the portions 714, 718, 722 are directly fixed to the other. The first portions 714 is disposed on one side of the luminaire 710 and the second portions 718 is disposed on another side of the luminaire 710, such that the first portions 714 and the second portions 718 are spaced apart from one another. Each first portion 714 and each second portion 718 are also spaced apart from each other. The third portion 722 is disposed between the first and second portions 714, 718. The third portion 722 is spaced apart from the first and second portions 714, 718, and a gap 726 is disposed between each adjacent portion 714, 718, 722.

Figure 17:
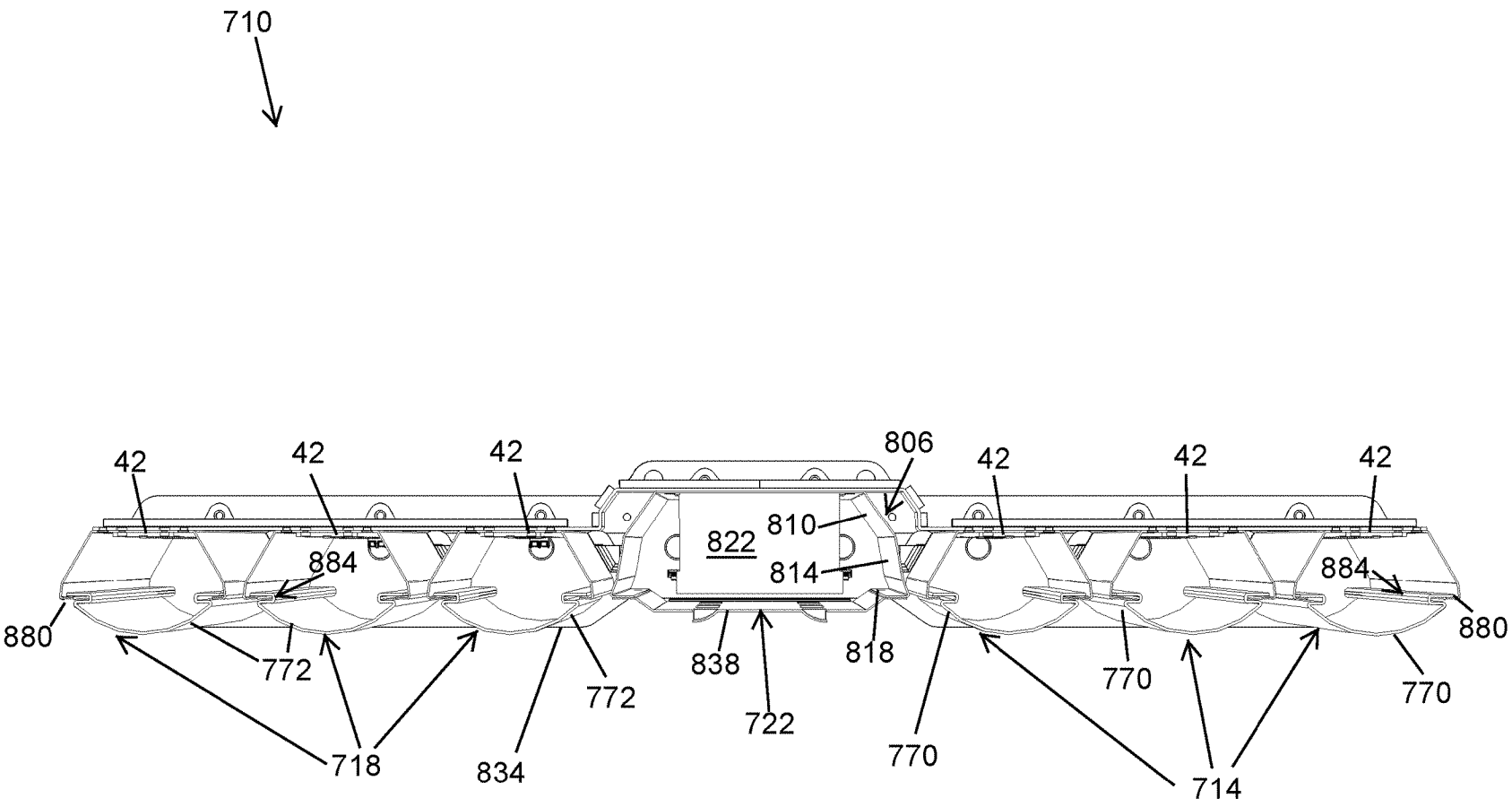
FIG. 17 is a cross sectional view of the luminaire of FIG. 14, viewed along section 17-17.

As shown in FIG. 17, each portion 714, 718, 722 has a substantially U-shape with a support surfaces 738, 758, and 802 respectively. LEDs 742 are coupled to the support surfaces 738, 758. In the illustrated embodiment, one strip of LEDs 742 are coupled to the each support surface 738, 758. Two side surfaces 740, 762, 806 extend from each support surface 738, 758, 802 respectively. A control housing 822 is coupled to the support surface 802 and houses various control elements (not shown) that are in electrical communication with each other and/or electrical elements disposed outside of the control housing 822. For example, the control elements are in electrical communication with the LEDs 826. The control elements may include current control, which drives a current output by the control elements.

The side surfaces 740, 762 include protuberances 880 that are received in pockets 884 on a lens 770, 772. The protuberances 880 have a substantially planar surface that abuts a substantially planar surface of the pockets 884. As described above, the arrangement of the protuberance 880 abutting the pockets 884 provides a snap-fit arrangement. In this arrangement though, the lenses 770, 772 may move in a direction transverse the axes 716, 720, 724 (i.e., the lenses 770, 772 may move toward the support surfaces 738, 758. To decouple the lenses 770, 772 from the portions 714, 718, 722, a user may provide a force directed toward a center of the lens 770, 772 so that the planar surfaces of the pocket 884 and the protuberance 880 no longer abut.

The side surfaces 806 include an oblique portion 810, an orthogonal portion 814, and a parallel portion 818. Each of the portions 810, 814, 818 is substantially planar surfaces. The oblique portion 810 is adjacent the support surface 802 and is disposed obliquely with respect to the support surface 802. The orthogonal portion 814 is adjacent the oblique portion 810 and disposed orthogonally with respect to the support surface 802, and obliquely with respect to the oblique portion 810. The parallel portion 818 is adjacent the orthogonal portion 802 and is disposed parallel with respect to the support surface 802 and orthogonally with respect to the orthogonal surface 814.

Figure 16:
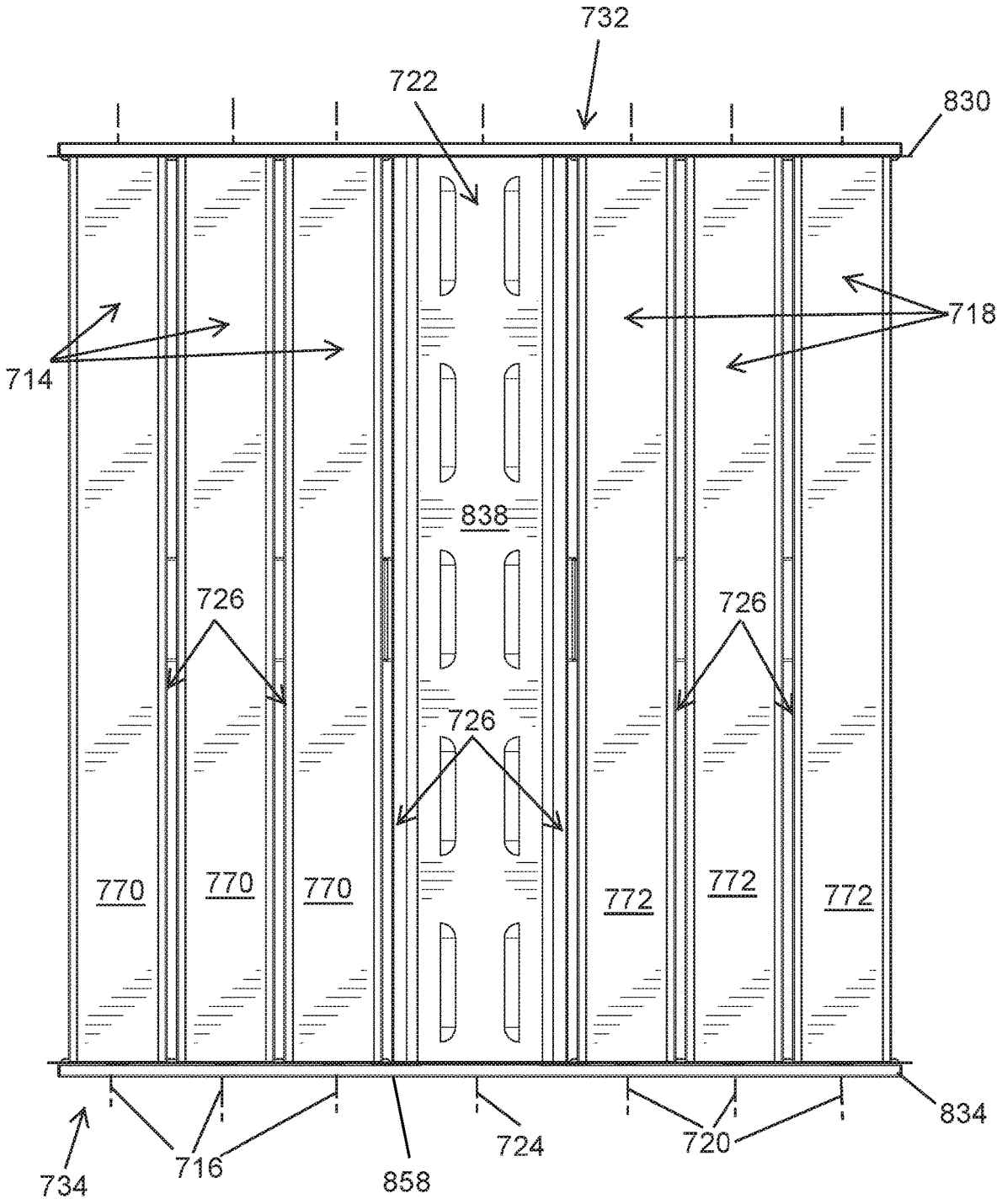
FIG. 16 is a lower view of the luminaire of FIG. 14.

A cover 838 is coupled to the third portion 722 proximate the parallel portions 818 and encloses the control housing 822. The cover 838 is removable from the lower surface of the third portion 722, facilitating access to the components in the third portion 722 for servicing or replacement purposes. As shown in FIG. 16, a fastening member 842 is disposed at either end of the third portion 722 (i.e., proximate the first end 732 and the second end 734) and is used to couple the cover 838 to the third portion 722. In the illustrated embodiment, the fastening members 842 are quarter-turn screws. Each quarter-turn screw 842 is rotatable ninety degrees between a lock position (i.e., where the cover 838 is coupled to the third portion 722) and an unlocked position (i.e., where the cover 838 is decoupled from the third portion 722).

Two end caps 830, 834 are coupled to each of the portions 714, 718, 722. In the illustrated embodiment, the portions 714, 718, 722 are disposed such that the respective support surfaces 738, 758, 802 are oriented in substantially the same direction. The first end cap 830 is coupled to the first end 732 of the luminaire 710. The second end cap 834 is coupled to the second end 734 of the luminaire 710. Each end cap 730, 734 includes a substantially similar profile as the combination of the three portions 714, 718, 722.

Figure 15:
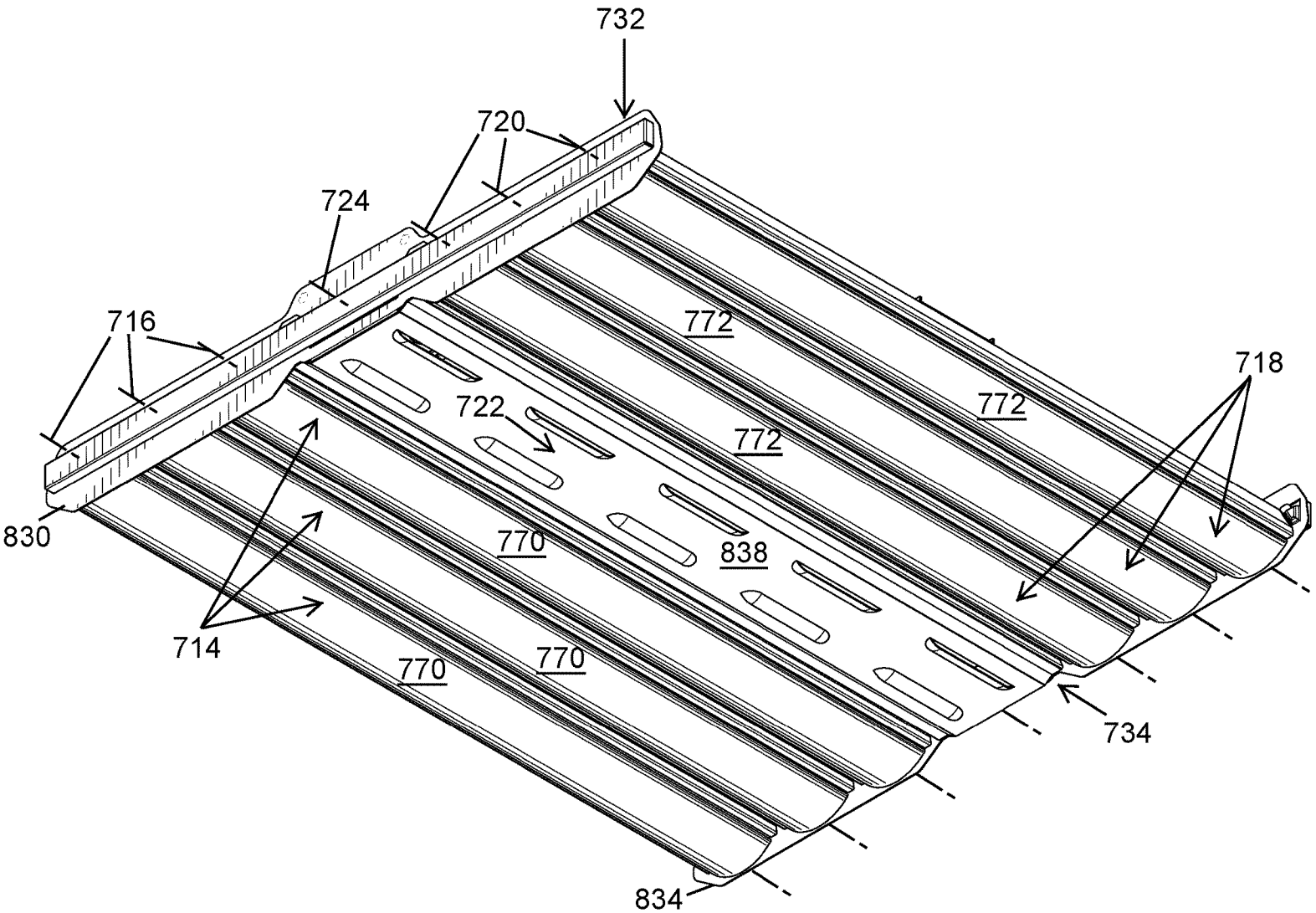
FIG. 15 is a lower perspective view of the luminaire of FIG. 14.

As shown in FIGS. 15 and 17, a mounting bracket 890 is coupled to the support surfaces 738, 758, 802 of all of the portions 714, 718, 722. The bracket 890 receives fasteners and provides an additional coupling means between the portions 714, 718, 722 of the luminaire. Each portion 714, 718, 722 may be independently removed from the mounting bracket 890.

As shown in FIG. 15, a bracket 858 is coupled to the end cap 834. The bracket 858 is substantially rectangular in shape and extends orthogonally with respect to the axes 716, 720, 724 while the end cap 834 is coupled to the portions 714, 718, 722. The bracket 858 includes a passage (not shown) that extends the length of the bracket 858. Electrical wiring (not shown) extends from the control housing 822 (FIG. 17) in the third portion 722 into the passage. The wiring travels through the passage to the first portion 714 and to the second portion 718. The wiring to provide current to the LEDs in both the first portion 714 and the second portion 718 is provided from one end of the fixture 710, simplifying assembly and servicing. The wiring electrically connects to the LEDs 742 and provides the LEDs 742 with a source of electrical current. The control elements disposed in the control housing 822 may control other aspects of the LEDs 742 (e.g., on/off controls, brightness controls, color hue controls).

The luminaire 710 is a low profile high bay light and is configured to be suspended from an elevated surface or ceiling (not shown). Cables (not shown) may extend through apertures 854 and anchor into the ceiling in order to secure the luminaire 710 to the ceiling. In other embodiments, brackets (not shown) may be coupled to the luminaire 710 proximate the support surface 802. Fasteners (e.g., threaded screws—not shown) may be received through the bracket to couple the luminaire 710 to the ceiling.

While coupled to the ceiling, the luminaire 710 is oriented so that the lenses 770, 772 face the floor. Light emitted from the LEDs 742 passes through the respective lenses 770, 772 and into a room. In some embodiments, the body of the luminaire 710 includes a gloss finish to improve surface reflectivity. The lenses 70, 72 can include prisms (not shown) to allow for narrow or wide light distribution. LEDs 826 are coupled to an outer surface of the third portion 722 oriented toward an opposite direction from the LEDs 742 (i.e., toward the ceiling). The LEDs 826 provide an up-light and illuminate the ceiling to avoid shadows and dark spots on the ceiling.

The quarter-turn screws 842 and the snap-fit lenses 770, 772 allow a user to easily access each portion 714, 718, 722 independently once the luminaire 710 has been mounted to the ceiling. The bracket 858 stores all of the wiring in a single passage to provide a clean look to the luminaire 710.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A luminaire comprising:

an elongated first portion supporting a first light emitter;

an elongated second portion laterally spaced from the first portion and oriented parallel to the first portion, the second portion supporting a second light emitter, the second light emitter oriented to emit light in substantially the same direction as the first light emitter; and an elongated third portion disposed laterally between the first portion and the second portion and oriented parallel to the first portion and the second portion, the third portion spaced apart from both the first portion and the second portion, the third portion supporting a current driver for driving at least one of the first light emitter and the second light emitter.

2. The luminaire of claim 1, wherein the third portion further includes a third light emitter oriented in a direction opposite the first and second light emitters such that light emitted from the third light emitter travels in a substantially opposite direction as the light emitted from the first and second light emitters.

3. The luminaire of claim 1, further comprising a bracket positioned coupling one end of the first portion, one end of the second portion, and one end of the third portion.

4. The luminaire of claim 1, wherein the first portion includes one of a concave portion and a convex portion, the luminaire further comprising a lens including another of a concave portion and a convex portion, one of the concave portion and the convex portion of the first portion nestable with another of the concave portion and the convex portion of the lens thereby providing a snap-fit arrangement to couple the lens to the second portion.

5. The luminaire of claim 1, wherein the first portion, the second portion, and the third portion are formed as a unitary piece.

6. The luminaire of claim 1, further comprising a cap positioned adjacent and extending between one end of the first portion, one end of the second portion, and one end of the third portion, wherein wires electrically connected between the a current driver and the at least one of the first light emitter and the second light emitter are positioned in a passage enclosed by the cap.

7. The luminaire of claim 1, further comprising a fourth portion laterally spaced from the first portion and oriented parallel to the first portion, the fourth portion supporting a third light emitter driven by a current driver; and a bracket oriented transverse to a longitudinal axis of the first portion, the bracket coupled to the first portion, the second portion, the third portion, and the fourth portion.

8. The luminaire of claim 1, further comprising a cover coupled to the third portion to provide access to an internal compartment from below the third portion.

9. A luminaire comprising:

an elongated first portion including a first end, a second end, and a first axis extending therebetween, the first portion supporting a first light emitting diode;

an elongated second portion including a first end, a second end, and a second axis extending therebetween and oriented parallel to the first axis, the second portion supporting a second light emitting diode and laterally spaced from the first portion; and a third portion disposed laterally between the first portion and the second portion, the third portion including a first end and a second end, a third axis extending therebetween and oriented parallel to the first axis, the third portion spaced apart from the first portion and the second portion and supporting a current driver in electrical communication with at least one of the first light emitting diode and the second light emitting diode;

a bracket coupling the first portion, the second portion, and the third portion.

10. The luminaire of claim 9, wherein the first and second light emitting diodes are oriented in the same direction such that light emitted from the first and second light emitting diodes travels in substantially the same direction; and the third portion further includes a third light emitting diode oriented in a direction opposite the first and second light emitting diodes such that light emitted from the third light emitting diode travels in a substantially opposite direction as the light emitted from the first and second light emitting diodes.

11. The luminaire of claim 9, further comprising a first lens coupled to the first portion and a second lens coupled to the second portion.

12. The luminaire of claim 9, further comprising a back pan coupled to the third portion, the back pan supporting a battery configured to supply electrical power to the light emitting diodes.

13. The luminaire of claim 9, further comprising a cap positioned extending between the first end of the first portion, the first end of the second portion, and the first end of the third portion, wires electrically connected between the current driver and the light emitters being positioned in the cap.

14. The luminaire of claim 9, further comprising a fourth portion laterally spaced from the first portion and supporting a fourth light emitting diode driven by a current driver, the fourth portion extends along a fourth axis oriented parallel to the first axis, wherein the bracket is oriented transverse to the first axis and coupling the first portion, the second portion, the third portion, and the fourth portion.

15. The luminaire of claim 9, further comprising a cover coupled to the third portion with quarter turn screws.

16. A luminaire comprising:

a first portion extending along a first axis and supporting a first light emitter;

a second portion laterally spaced from the first portion and extending along a second axis oriented parallel to the first axis, the second portion supporting a second light emitter;

a third portion disposed between the first portion and the second portion and extending along a third axis oriented parallel to the first axis, the third portion spaced apart from the first portion and the second portion, the third portion supporting at least one current driver in electrical communication with at least one of the first light emitter and the second light emitter;

a first lens coupled to the first portion;

a second lens is coupled to the second portion, the second lens oriented in substantially the same direction as the first lens; and a cover removably coupled to the third portion, the cover having a surface facing in the same direction as the first lens and the second lens.

17. The luminaire of claim 16, wherein the first and second light emitters are oriented in the same direction such that light emitted from the first and second light emitters travels in substantially the same direction; and the third portion further includes a third light emitter oriented in a direction opposite the first and second light emitters such that light emitted from the third light emitter travels in a substantially opposite direction as the light emitted from the first and second light emitters.

18. The luminaire of claim 16, wherein each of the first lens and the second lens has a curved profile.

19. The luminaire of claim 16, further comprising a fourth portion laterally spaced from the first portion and extending along a fourth axis oriented parallel to the first axis, the fourth portion supporting a light emitter driven by one of the at least one current driver; and a bracket oriented transverse to the first axis and coupled to the first portion, the second portion, the third portion, and the fourth portion.

* * * * *